US012152474B2

(12) United States Patent
Brown et al.

(10) Patent No.: US 12,152,474 B2
(45) Date of Patent: Nov. 26, 2024

(54) ELECTRIC SUBMERSIBLE PUMP (ESP) ASSEMBLY FLUID INTAKE EXTENSION

(71) Applicant: Halliburton Energy Services, Inc., Houston, TX (US)

(72) Inventors: Donn J. Brown, Tulsa, OK (US); Ketankumar Kantilal Sheth, Tulsa, OK (US); Andre Joseph Bernier, Tulsa, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 108 days.

(21) Appl. No.: 17/954,855

(22) Filed: Sep. 28, 2022

(65) Prior Publication Data

US 2024/0102366 A1 Mar. 28, 2024

(51) Int. Cl.
*E21B 43/12* (2006.01)
*E21B 43/38* (2006.01)

(52) U.S. Cl.
CPC ..... *E21B 43/128* (2013.01); *E21B 43/38* (2013.01)

(58) Field of Classification Search
CPC ..... E21B 43/128; E21B 43/38
See application file for complete search history.

(56) References Cited

U.S. PATENT DOCUMENTS 3,195,661 A 7/1965 Jackson et al.
4,187,912 A 2/1980 Cramer
4,481,020 A 11/1984 Lee et al.
4,901,413 A 2/1990 Cotherman et al.
4,913,630 A 4/1990 Cotherman et al.
5,207,810 A 5/1993 Sheth
(Continued)

FOREIGN PATENT DOCUMENTS

CN 106076006 A 11/2016
CN 205965282 U 2/2017
(Continued)

OTHER PUBLICATIONS

Foreign Communication from Related Application—International Search Report and Written Opinion of the International Searching Authority, International Application No. PCT/US2020/022038, dated Nov. 27, 2020, 13 pages.
(Continued)

*Primary Examiner* — J. Todd Newton
(74) *Attorney, Agent, or Firm* — Conley Rose, P.C.; Rodney B. Carroll

(57) ABSTRACT

An electric submersible pump (ESP) assembly. The ESP assembly comprises an electric motor; a seal section coupled to an uphole end of the electric motor; a fluid intake coupled to an uphole end of the seal section, wherein the fluid intake defines a plurality of inlet ports; a gas separator coupled to an uphole end of the fluid intake, wherein the gas separator has a plurality of gas phase discharge ports; a pump assembly coupled to an uphole end of the gas separator; and an intake extension tubular, wherein an uphole end of the intake extension tubular is coupled to the fluid intake uphole of the inlet ports, and wherein an annulus defined between an inside of the intake extension tubular and an outside of the seal section defines a fluid flow path from a downhole end of the intake extension tubular to the inlet ports of the fluid intake.

20 Claims, 9 Drawing Sheets

(56) References Cited

U.S. PATENT DOCUMENTS

| | | | | |
|---|---|---|---|---|
| 5,431,228 | A | 7/1995 | Weingarten et al. | |
| 5,525,146 | A | 6/1996 | Straub | |
| 6,066,193 | A | 5/2000 | Lee | |
| 6,113,675 | A | 9/2000 | Branstetter | |
| 6,155,345 | A | 12/2000 | Lee et al. | |
| 6,382,317 | B1 | 5/2002 | Cobb | |
| 6,412,562 | B1 | 7/2002 | Shaw | |
| 6,705,402 | B2 | 3/2004 | Proctor | |
| 7,461,692 | B1 | 12/2008 | Wang | |
| 7,462,225 | B1 | 12/2008 | Ketter et al. | |
| 7,766,081 | B2 | 8/2010 | Brown et al. | |
| 8,079,418 | B2 | 12/2011 | Brown et al. | |
| 8,955,598 | B2 | 2/2015 | Brown et al. | |
| 9,283,497 | B2 | 3/2016 | Wang et al. | |
| 10,378,322 | B2 | 8/2019 | Ejim et al. | |
| 10,408,035 | B2 | 9/2019 | Kennedy et al. | |
| 11,149,535 | B2 | 10/2021 | Brown et al. | |
| 11,624,269 | B2 | 4/2023 | Sheth et al. | |
| 11,661,828 | B2 | 5/2023 | Conrad et al. | |
| 2002/0153141 | A1 | 10/2002 | Hartman et al. | |
| 2002/0174982 | A1 | 11/2002 | Weingarten | |
| 2003/0111230 | A1 | 6/2003 | Olson et al. | |
| 2004/0031608 | A1 | 2/2004 | Hall et al. | |
| 2009/0044953 | A1* | 2/2009 | Sheth | E21B 47/008 166/105 |
| 2009/0065202 | A1* | 3/2009 | Brown | E21B 43/128 166/267 |
| 2009/0194295 | A1 | 8/2009 | Thompson et al. | |
| 2010/0147514 | A1 | 6/2010 | Swaringin | |
| 2010/0319926 | A1 | 12/2010 | Reid | |
| 2011/0162832 | A1 | 7/2011 | Reid | |
| 2012/0012332 | A1 | 1/2012 | Rooks | |
| 2012/0073800 | A1 | 3/2012 | Janitz | |
| 2013/0068455 | A1 | 3/2013 | Brown et al. | |
| 2014/0174734 | A1 | 6/2014 | Gill et al. | |
| 2015/0192141 | A1 | 7/2015 | Nowitzki et al. | |
| 2016/0130922 | A1 | 5/2016 | Wilson et al. | |
| 2016/0130923 | A1 | 5/2016 | Nowitzki et al. | |
| 2016/0201444 | A1 | 7/2016 | Hardee et al. | |
| 2016/0222770 | A1* | 8/2016 | Kirk | E21B 43/38 |
| 2016/0312590 | A1 | 10/2016 | Chang et al. | |
| 2017/0081952 | A1 | 3/2017 | Osborne et al. | |
| 2018/0274344 | A1* | 9/2018 | Ejim | E21B 47/008 |
| 2019/0162063 | A1 | 5/2019 | Brown et al. | |
| 2019/0234193 | A1 | 8/2019 | Fehri | |
| 2019/0264551 | A1* | 8/2019 | Brown | E21B 43/128 |
| 2019/0316452 | A1* | 10/2019 | Brown | E21B 43/128 |
| 2020/0141223 | A1 | 5/2020 | Brown et al. | |
| 2020/0362649 | A1 | 11/2020 | Brown et al. | |
| 2022/0065090 | A1 | 3/2022 | Ejim | |
| 2023/0010704 | A1 | 1/2023 | Sheth et al. | |
| 2023/0014297 | A1 | 1/2023 | Brown et al. | |
| 2023/0105823 | A1 | 4/2023 | Brown et al. | |
| 2023/0111850 | A1 | 4/2023 | Sheth et al. | |
| 2023/0220751 | A1 | 7/2023 | Sheth et al. | |

FOREIGN PATENT DOCUMENTS

| | | | |
|---|---|---|---|
| WO | 2017053624 | A1 | 3/2017 |
| WO | 2020072078 | A1 | 4/2020 |
| WO | 2023282919 | A1 | 1/2023 |
| WO | 2023282920 | A1 | 1/2023 |

OTHER PUBLICATIONS

Foreign Communication from Related Application—International Search Report and Written Opinion of the International Searching Authority, International Application No. PCT/US2021/042395, dated Mar. 25, 2022, 14 pages.

Foreign Communication from Related Application—International Search Report and Written Opinion of the International Searching Authority, International Application No. PCT/US2021/042389, dated Apr. 4, 2022, 11 pages.

Foreign Communication from Related Application—International Search Report and Written Opinion of the International Searching Authority, International Application No. PCT/US2023/013758, dated Jun. 9, 2023, 10 pages.

Office Action dated Nov. 10, 2022 (25 pages), U.S. Appl. No. 17/369,526, filed Jul. 7, 2021.

Office Action dated Jan. 3, 2023 (50 pages), U.S. Appl. No. 17/369,526, filed Jul. 7, 2021.

Office Action dated Mar. 31, 2023 (37 pages), U.S. Appl. No. 17/492,230, filed Oct. 1, 2021.

Filing Receipt, Specification and Drawings for U.S. Appl. No. 17/954,849, filed Sep. 28, 2022, entitled "Electric Submersible Pump (ESP) Shroud System," 56 pages.

Final Office Action dated May 22, 2023 (9 pages), U.S. Appl. No. 17/369,526, filed Jul. 7, 2021.

First Office Action dated Jun. 8, 2023 (34 pages), U.S. Appl. No. 17/737,148, filed May 5, 2022.

Schlumberger Oilfield Glossary entry for "slug flow", accessed Sep. 8, 2023 via glossary.slb.com.

Office Action dated Sep. 14, 2023 (42 pages), U.S. Appl. No. 17/369,526, filed Jul. 7, 2021.

Foreign Communication from Related Application—International Search Report and Written Opinion of the International Searching Authority, International Application No. PCT/US2023/025736, dated Oct. 17, 2023, 11 pages.

Foreign Communication from Related Application—International Search Report and Written Opinion of the International Searching Authority, International Application No. PCT/US2023/025717, dated Oct. 12, 2023, 12 pages.

First Office Action dated Aug. 17, 2023 (51 pages), U.S. Appl. No. 17/492,227, filed Oct. 1, 2021.

* cited by examiner

ELECTRIC SUBMERSIBLE PUMP (ESP) ASSEMBLY FLUID INTAKE EXTENSION

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Electric submersible pumps (hereafter "ESP" or "ESPs") may be used to lift production fluid in a wellbore. Specifically, ESPs may be used to pump the production fluid to the surface in wells with low reservoir pressure. ESPs may be of importance in wells having low bottomhole pressure or for use with production fluids having a low gas/oil ratio, a low bubble point, a high water cut, and/or a low API gravity. Moreover, ESPs may also be used in any production operation to increase the flow rate of the production fluid to a target flow rate.

Generally, an ESP comprises an electric motor, a seal section, a pump intake, and one or more pumps (e.g., a centrifugal pump). These components may all be connected with a series of shafts. For example, the pump shaft may be coupled to the motor shaft through the intake and seal shafts. An electric power cable provides electric power to the electric motor from the surface. The electric motor supplies mechanical torque to the shafts, which provide mechanical power to the pump. Fluids, for example reservoir fluids, may enter the wellbore where they may flow past the outside of the motor to the pump intake. These fluids may then be produced by being pumped to the surface inside the production tubing via the pump, which discharges the reservoir fluids into the production tubing.

The reservoir fluids that enter the ESP may sometimes comprise a gas fraction. These gases may flow upwards through the liquid portion of the reservoir fluid in the pump. The gases may even separate from the other fluids when the pump is in operation. If a large volume of gas enters the ESP, or if a sufficient volume of gas accumulates on the suction side of the ESP, the gas may interfere with ESP operation and potentially prevent the intake of the reservoir fluid. This phenomenon is sometimes referred to as a "gas lock" because the ESP may not be able to operate properly due to the accumulation of gas within the ESP.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
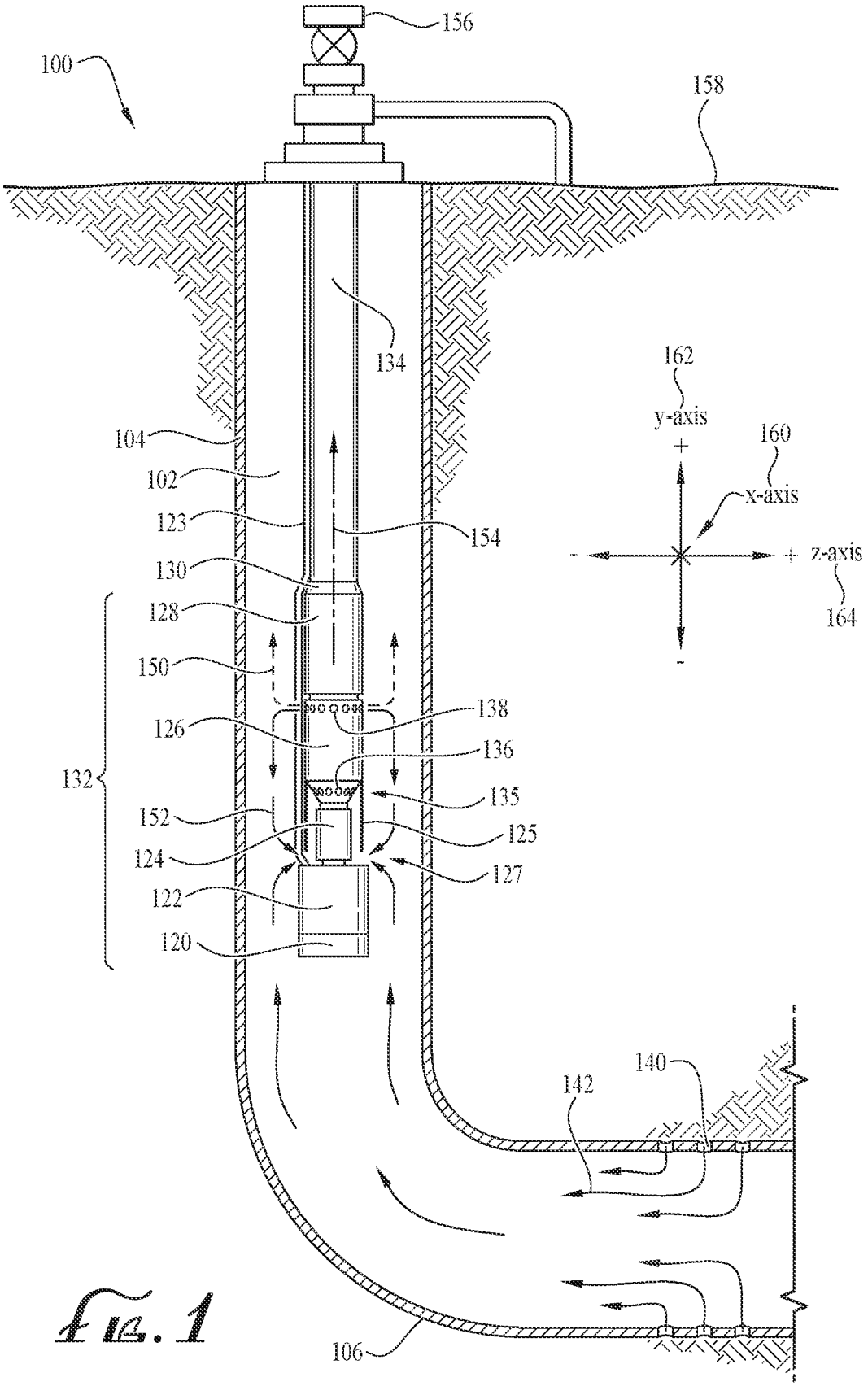
FIG. 1 is an illustration of a well site and ESP assembly in a wellbore according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "upstream," "downstream," "up," and "down" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid.

Gas entering a centrifugal pump of an electric submersible pump (ESP) assembly can cause various difficulties for a centrifugal pump. In an extreme case, the pump may become gas locked and become unable to pump fluid. In less extreme cases, the pump may experience harmful operating conditions when transiently passing a slug of gas. When in operation, the centrifugal pump rotates at a high rate of speed (e.g., about 3600 RPM) and relies on the continuous flow of reservoir liquid to both cool and lubricate its bearing surfaces. When this continuous flow of reservoir liquid is interrupted, even for a brief period of seconds, the bearings of the centrifugal pump may heat up rapidly and undergo significant wear, shortening the operational life of the centrifugal pump, thereby increasing operating costs due to more frequent change-out and/or repair of the centrifugal pump. Down time involved in repairing or replacing the centrifugal pump may also interrupt well production undesirably. In some operating environments, for example in some horizontal wellbores, gas slugs that persist for at least 10 seconds are repeatedly experienced. Some gas slugs may persist for as much as 30 seconds or more. The present disclosure teaches a new ESP assembly fluid intake extension that mitigates the effects of gas slugs.

A gas separator comprises an inlet at its downhole end that receives fluid from a fluid intake defining a plurality of inlet ports, where the fluid intake is coupled to a downhole end of the gas separator assembly. The fluid may comprise reservoir fluid flowing uphole from a subterranean formation as well as fluid that exits a gas discharge port of the gas separator. The gas separator inlet feeds the received fluid to one or more fluid mover (e.g., a paddle wheel, an auger, a centrifugal impeller, and/or a vortex inducer) that imparts a rotating motion to the reservoir fluid. The rotating fluid flows from the fluid mover into a separation chamber. The rotation of the fluid in the separation chamber tends to separate gas phase fluid from liquid phase fluid. In an embodiment, the separation chamber may enclose a stationary auger that further helps to cause the fluid to rotate.

Due to the rotation of the fluid, the relatively lower density gas phase fluid tends to concentrate near a centerline axis of the gas separator assembly (e.g., near a drive shaft of the gas separator assembly), and the relatively higher density liquid phase fluid tends to concentrate near an inside wall of a housing or separation chamber of the gas separator assembly. In an embodiment, an uphole end of the separation chamber may be empty to better promote liquid rich fluid to separate from gas rich fluid. The fluid near the centerline axis enters a gas phase discharge of the gas separator assembly and exits the gas separator assembly to an annulus formed between the wellbore and the outside of the ESP assembly; the fluid near the inside wall enters a liquid phase discharge of the gas separator assembly and is directed downstream to another stage of the gas separator assembly or to an inlet of the centrifugal pump assembly. In this way the fluid that is fed downstream to the inlet of the centrifugal pump assembly may be said to be a liquid enriched fluid or a liquid enriched fraction of the received fluid. In practice, fluid that is exhausted out the gas phase discharge of the gas separator assembly has a tendency to, at least in part, flow back to the fluid intake, potentially mixing gas with liquid phase fluid at the fluid intake, increasing the gas-to-liquid ratio of the fluid flowing into the fluid intake. This may be referred to as recirculation, and when a high gas-to-liquid ratio fluid is exhausted out of the gas phase discharge of the gas separator, this recirculation can be a technical problem.

As taught herein, an intake extension tubular at least partially encloses a seal section of the ESP assembly which is located downhole of the fluid intake. The intake extension tubular couples to the fluid intake uphole of the inlet ports of the fluid intake, thereby defining an annulus between an inside of the intake extension tubular and an outside of the seal section, where this annulus provides a flow path for fluid to flow from outside the intake extension tubular, uphole in the annulus defined between the inside of the intake extension tubular and the outside of the seal section, and to flow to the intake ports of the fluid intake. The intake extension tubular increases the distance that fluid exhausted from the gas phase discharge ports of the gas separator travels before it can be recirculated into the inlet ports of the fluid intake, thereby increasing opportunity for gas in the fluid to bubble out of suspension in the fluid and to rise uphole outside the ESP assembly, thereby enriching the liquid content (e.g., reducing the gas-to-liquid ratio) of the fluid that is recirculated into the intake ports of the fluid intake. It is generally desirable for the gas separator assembly and the centrifugal pump to receive fluid having a lower gas-to-liquid ratio.

When reservoir fluid is primarily liquid phase fluid, the gas separator assembly may exhaust primarily liquid phase fluid out of the gas phase discharge of the gas separator assembly. This primarily liquid phase fluid flows down the outside of the gas separator assembly and the outside of the intake extension tubular and fills an annulus defined between the inside of the wellbore and the outside of the gas separator assembly and the outside of the intake extension tubular. This column of primarily liquid phase fluid constitutes a reservoir that can be beneficial during a transient gas slug when the primarily liquid phase fluid that has accumulated may mix with the gas phase fluid of the gas slug in the opening to the annulus defined by the inside of the extended intake tubular and the outside of the seal section to reduce the gas-to-liquid ratio of the fluid flowing into the fluid intake (that is, reduce the gas-to-liquid ratio of fluid entering the fluid intake relative to what it would be if only the gas flowing downstream from the subterranean formation were entering the fluid intake). It is noted that in this case too (e.g., the state of primarily liquid phase fluid flowing downstream past the electric motor and primarily liquid phase fluid filling the annulus between the inside of the wellbore and the outside of the gas separator assembly and the outside of the intake extension tubular, the longer or more extended the intake extension tubular, the more the capacity of the ESP assembly to sustain a lengthy gas slug while drawing down the reservoir of primarily liquid phase fluid to mix with the gas of the gas slug at the entrance of the intake extension tubular.

Turning now to FIG. 1 a well site environment 100, according to one or more aspects of the disclosure, is described. The well site environment 100 comprises a wellbore 102 that is at least partially cased with casing 104. As depicted in FIG. 1, the wellbore 102 has a deviated or horizontal portion 106, but the electric submersible pump (ESP) assembly 132 described herein may be used in a wellbore 102 that does not have a deviated or horizontal portion 106. The well site environment 100 may be at an on-shore location or at an off-shore location. The ESP assembly 132 in an embodiment comprises a sensor package 120, an electric motor 122, a seal section 124, a fluid intake 135 defining a plurality of inlet ports 136, a gas separator assembly 126, and a centrifugal pump assembly 128.

An intake extension tubular 125 is coupled to the fluid intake 135 uphole of the intake ports 136 and extends downhole to at least partially enclose the seal section 124. In an embodiment, the intake extension tubular 125 encloses at least three quarters of the seal section 124. In an embodiment, the intake extension tubular 125 encloses at least one half of the seal section 124. In an embodiment, the intake extension tubular 125 encloses at least three fifths of the seal section 124. In an embodiment, the intake extension tubular 125 encloses at least seven eighths of the seal section 124. Said in other words, the axial length of the outside of the intake extension tubular 125, when it is installed to the ESP assembly 132, extends over at least one half, at least three fifths, at least three quarters, or at least seven eighths of the axial length of the seal section 124. In an embodiment, the seal section 124 may comprise a single seal, a tandem seal (e.g., two seals coupled to each other), a triple seal (e.g., three seals coupled to each other), or other such multiple seal combinations. In an embodiment, the intake extension tubular 125 encloses the seal section 124 and part or all of the electric motor 122.

In an embodiment, the intake extension tubular 125 may be from about 2 feet long to about 50 feet long. In an embodiment, the intake extension tubular 125 may be from about 2 feet long to about 45 feet long. In an embodiment, the intake extension tubular 125 may be from about 2 feet long to about 40 feet long. In an embodiment, the intake extension tubular 125 may be from about 2 feet long to about 35 feet long. In an embodiment, the intake extension tubular 125 may be from about 2 feet long to about 30 feet long. In an embodiment, the intake extension tubular 125 may be from about 2 feet long to about 25 feet long. In an embodiment, the intake extension tubular 125 may be from about 2 feet long to about 20 feet long. In an embodiment, the intake extension tubular 125 may be from about 2 feet long to about 15 feet long. In an embodiment, the intake extension tubular 125 may be from about 2 feet long to about 10 feet long. In an embodiment, the intake extension tubular 125 may be from about 1 foot long to about 5 feet long. In an embodiment, the outside diameter of the intake extension tubular 125 is about 3.38 inches, about 4 inches, about 5.13 inches, about 5.38 inches, about 5.5 inches, about 5.75 inches, about 6 inches, or some other diameter.

The centrifugal pump assembly may couple to a production tubing 134 via a connector 130. In some context, the connector 130 may be referred to as a pump discharge. An electric cable 123 may attach to the electric motor 122 and extend to the surface 158 to connect to an electric power source (not shown). In an embodiment, an inverted shroud (not shown) may be sealingly attached at a downhole end of the inverted shroud to an outside of the gas separator assembly 126 below gas phase discharge ports of the gas separator assembly and attached at an uphole end of the inverted shroud to an outside of the centrifugal pump assembly 128 or to an outside of the production tubing 134. The combination of the intake extension tubular 125 and the inverted shroud can further increase the flow path of fluid exhausted from the gas phase discharge ports of the gas separator assembly 126 and thereby encourage further the bubbling out of gas from the exhausted fluid.

The casing 104 and/or wellbore 102 may have perforations 140 that allow reservoir fluid 142 to pass from the subterranean formation through the perforations 140 and into the wellbore 102. The reservoir fluid 142 may comprise hydrocarbons such as crude oil and/or natural gas. The reservoir fluid 142 may comprise hot water, for example when the wellbore 102 is a geothermal well. The reservoir fluid 142 may flow uphole towards the ESP assembly 132, enter an opening 127 at a downhole end of the intake extension tubular 125, flow up the inside of the intake extension tubular 125, and flow into the inlet ports 136.

The reservoir fluid 142 may comprise liquid phase fluids. The reservoir fluid 142 may comprise gas phase fluids mixed with liquid phase fluids. The reservoir fluid 142 may comprise only a gas phase fluid (e.g., simply gas). Over time, the gas-to-liquid ratio of the reservoir fluid 142 may change dramatically. For example, in the horizontal portion 106 of the wellbore gas may build up in high points in the roof of the wellbore 102 and after accumulating sufficiently may "burp" out of these high points and flow downstream to the ESP assembly 132 as what is commonly referred to as a gas slug. Thus, immediately before a gas slug arrives at the ESP assembly 132, the gas-to-liquid ratio of the reservoir fluid 142 may be very low (e.g., the reservoir fluid 142 at the ESP assembly 132 is mostly liquid phase fluid); when the gas slug arrives at the ESP assembly 132, the gas-to-liquid ratio is very high (e.g., the reservoir fluid 142 at the ESP assembly 132 is entirely or almost entirely gas phase fluid); and after the gas slug has passed the ESP assembly 132, the gas-to-liquid ratio may again be very low (e.g., the reservoir fluid 142 at the ESP assembly 132 is mostly liquid phase fluid).

Fluid received through the inlet ports 136 of the fluid intake 135 may flow into a downhole end of the gas separator assembly 126, for example into an inlet of the gas separator assembly 126. The gas separator assembly 126 comprises gas phase discharge ports 138 (best seen in FIG. 2A).

Under normal operating conditions (e.g., reservoir fluid 142 is flowing out of the perforations 140, the ESP assembly 132 is energized by electric power, the electric motor 122 is turning, and a gas slug is not present at the opening 127 at the downhole end of the intake extension tubular 125), the reservoir fluid 142 enters the opening 127, flows uphole inside the intake extension tubular 125, flows into the inlets 136, and the reservoir fluid 142 is separated by the gas separator assembly 126 into a gas phase fluid (or a mixed-phase fluid having a higher gas-to-liquid ratio than the reservoir fluid 142 entering the inlet ports 136) and into a liquid phase fluid (or a mixed-phase fluid having a lower gas-to-liquid ratio than the reservoir fluid 142 entering the inlet ports 136). The gas phase fluid is discharged via the gas phase discharge ports 138 into the wellbore 102, and the liquid phase fluid is flowed downstream to the centrifugal pump assembly 128 as liquid phase fluid 154. Under normal operating conditions, the gas phase fluid that is discharged from the gas phase discharge ports 138 into the annulus between the casing 104 and the outside of the ESP assembly 132 may comprise both gas phase fluid 150 that rises uphole in the wellbore 102 and liquid phase fluid 152 that falls downhole in the wellbore 102. In some contexts, the fluid 152 may be referred to as recirculating fluid. The centrifugal pump assembly 128 flows the liquid phase fluid 154 (e.g., a portion of the reservoir fluid 142) up the production tubing 134 to a wellhead 156 at the surface 158.

An orientation of the wellbore 102 and the ESP assembly 132 is illustrated in FIG. 1 by an x-axis 160, a y-axis 162, and a z-axis 164. In an embodiment, the centrifugal pump assembly 128 comprises one or more centrifugal pump stages, where each stage comprises an impeller that is mechanically coupled to a drive shaft within the centrifugal pump assembly 128 and a corresponding diffuser that is stationary and retained by a housing of the centrifugal pump assembly 128. In an embodiment, the impellers may comprise a keyway that mates with a corresponding keyway on the drive shaft of the centrifugal pump assembly 128 and a key may be installed into the two keyways, wherein the impeller may be mechanically coupled to the drive shaft of the centrifugal pump assembly.

Figure 2A:
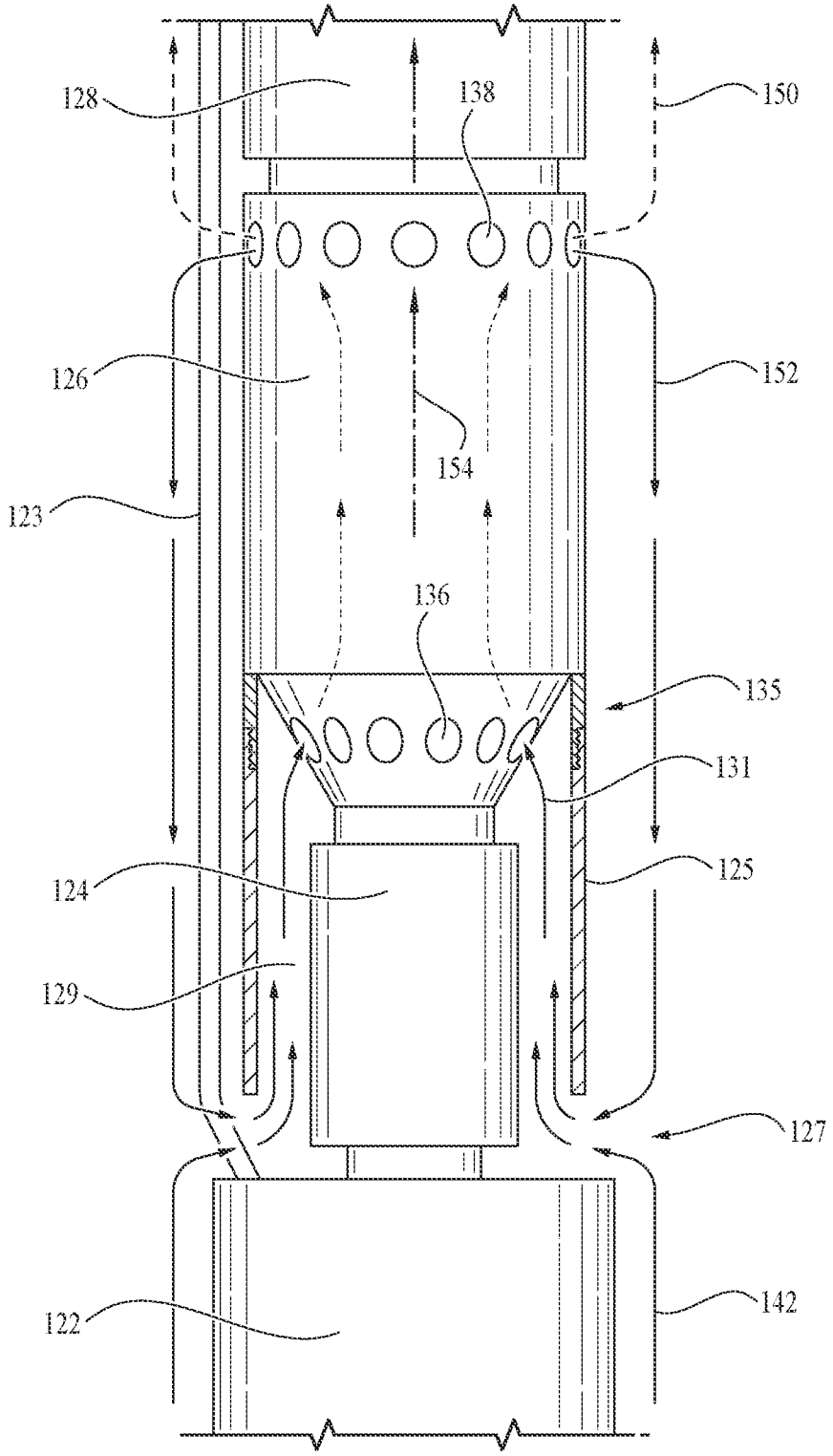
FIG. 2A is an illustration of a portion of an ESP assembly according to an embodiment of the disclosure.

Turning now to FIG. 2A, further details of the ESP assembly 132 and the intake extension tubular 125 are described. An annulus defined between an inside of the intake extension tubular and an outside of the seal section 124 establishes a fluid flow path 129 from the opening 127 to the inlet ports 136 of the fluid intake 135. The intake extension tubular 125 may be formed of a pipe or other tubular metal material. The intake extension tubular 125 may be formed of two or more joints of pipe or joints of tubular metal material that are coupled together end-to-end, for example threadingly coupled together. In an embodiment, the intake extension tubular 125 defines female threads at an uphole end that mate with male threads on a portion of the fluid intake 135 at a point uphole of the inlet ports 136.

Reservoir fluid 142 and fluid 152 enter the opening 127 at the downhole end of the intake extension tubular 125 and mixes to form the combined fluid. The combined fluid 131 flows uphole in the fluid flow path 129 to the inlet ports 136 and enter the interior of the gas separator assembly 126. A fluid mover inside the gas separator assembly 126 is coupled to a drive shaft in the gas separator that is coupled to a drive shaft in the seal section 124. The drive shaft in the seal section 124 is coupled to a drive shaft of the electric motor 122. The turning drive shaft inside the gas separator assembly 126 turns the fluid mover, causing the combined fluid 131 to rotate and separate into a gas phase fluid (or a higher gas-to-liquid ratio fluid) that exits the gas phase discharge ports 138 and a liquid phase fluid (or a lower gas-to-liquid ratio fluid) that flows uphole to the centrifugal pump assembly 128. The liquid phase fluid is labeled as fluid 154 in FIG.

2A. While the gas phase fluid and liquid phase fluid as illustrated in FIG. 2A is shown separated at the downhole end of the gas separator assembly 126, it is understood that the gas phase fluid and liquid phase fluid are not separated until it reaches the middle portion of the gas separator assembly 126 or the uphole portion of the gas separator assembly 126. The gas phase fluid and liquid phase fluid separate after the fluid 131 has been processed by a fluid mover of the gas separator assembly 126 and has flowed uphole of the fluid mover into a separation chamber of the gas separator assembly 126 just downhole of the gas phase discharge ports 138 and downhole of the at least one liquid phase discharge port.

The fluid that exits the gas phase discharge ports 138 may separate partly into a first fluid portion (e.g., free gas or gas bubbles) 150 that rises in the annulus formed between the casing 104 and the outside of the ESP assembly 132 and a second fluid portion 152 that falls in the annulus between the casing 104 and the outside of the ESP assembly 132 to recirculate into the opening 127. The greater the distance the second fluid portion 152 travels from the gas discharge ports 138 to the opening 127, the more opportunity for gas to bubble out of the second fluid portion 152 and to rise in the annulus between the casing 104 and the outside of the ESP assembly 132.

In an embodiment, the outside diameter of the intake extension tubular 125 is about equal to the outside diameter of the gas separator assembly 126 and to the outside diameter of the centrifugal pump assembly 128. For example, in an embodiment, the outside diameter of the intake extension tubular 125 is equal to the outside diameter of the gas separator assembly 126 and to the outside diameter of the centrifugal pump assembly 128 within +/−0.025 inch, within +/−0.05 inch, within +/−0.075 inch, within +/−0.1 inch, within +/−0.15 inch, within +/−0.2 inch, within +/−0.25 inch, within +/−0.3 inch, within +/−0.35 inch, within +/−0.4 inch, within +/−0.45 inch, or within +/−0.5 inch. The seal section 124 has a smaller outside diameter than the inside diameter of the intake extension tubular 125. In an embodiment, the outside diameter of the electric motor 122 is larger than the outside diameter of the intake extension tubular 125. In an embodiment, the casing 104 is about 5 ½ inch casing. In an embodiment, the outside diameter of the electric motor 122 is about 4 9/16 inches (e.g., about 4.56 inches). In an embodiment, the outside diameter of the seal section 124 is about 3⅜ inches (e.g., about 3.38 inches). In an embodiment, the outside diameter of the intake extension tubular 125 is about 4 inches. In an embodiment, the electric cable 123 is coupled to an outside of the centrifugal pump assembly 128, coupled to an outside of the gas separator assembly 126, coupled to an outside of the intake extension tubular 125, and attaches to the electric motor 122 via a pot head plug (not shown). Because the outside diameters of the intake extension tubular 125, of the gas separator assembly 126, and of the centrifugal pump assembly 128 are about the same, the electric cable 123 can be smoothly aligned and remain substantially parallel with a centerline of the ESP assembly 132 without having to make any bends or dips which can help avoid hanging the electric cable 123 on the casing 104 or on other objects when running into the wellbore 102.

Figure 2B:
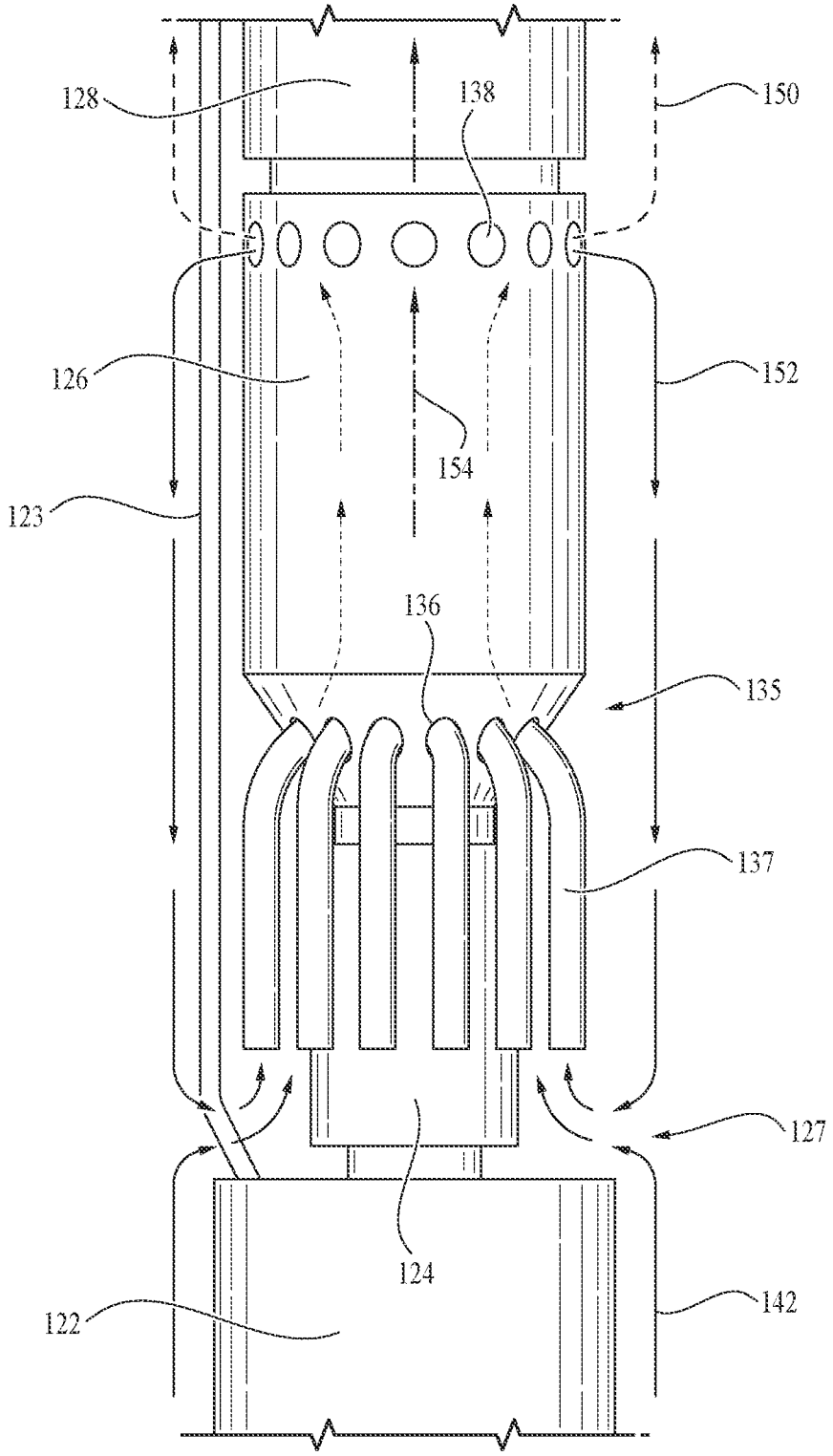
FIG. 2B is an illustration of a portion of an ESP assembly according to an embodiment of the disclosure.

Turning now to FIG. 2B, an alternative embodiment of the intake extension tubular 125 is described. Rather than the intake extension tubular 125 that couples to the downhole end of the gas separator assembly 126 or to the uphole end of the fluid intake 135 and defines flow path 129 as the annulus between the inside of the intake extension tubular 125 and the outside of the seal section 124, a plurality of intake extension tubulars 137 are provided, where each intake extension tubular 137 is coupled to one of the inlet ports 136. The intake extension tubulars 137 may be coupled to the inlet ports 136 by welds. The intake extension tubulars 137 may be coupled to the inlet ports 136 by at least one bolt. The intake extension tubulars 137 may be coupled to the inlet ports 136 by a bracket. The downhole ends of the intake extension tubulars 137 may extend fractionally along the outside of the seal section 124 or beyond the seal section 124 and over the outside of the electric motor 122, analogous to how the intake extension tubular 125 described above may extend fractionally along the outside of the seal section 124 or beyond the seal section 124 and over the outside of the electric motor 122. In an embodiment, each of the intake extension tubulars 137 extends downhole at least one half, two thirds, three fourths, four fifths, or a different fraction from the uphole end of the seal section 124. In an embodiment, the downhole ends of the plurality of intake extension tubulars 137 may be secured to the outside of the seal section 124 and/or to an outside of the electric motor 122 by a retaining band, whereby to prevent the intake extension tubulars 137 from hanging on the wellbore 102 or casing 104 during run-in of the ESP assembly 132 and being bent out of position. Reservoir fluid 142 and fluid 152 (e.g., recirculating fluid) enters the downhole openings of the plurality of intake extension tubulars 137, flow upwards inside the intake extension tubulars 137, and enter the downhole end of the gas separator assembly 126.

Figure 3:
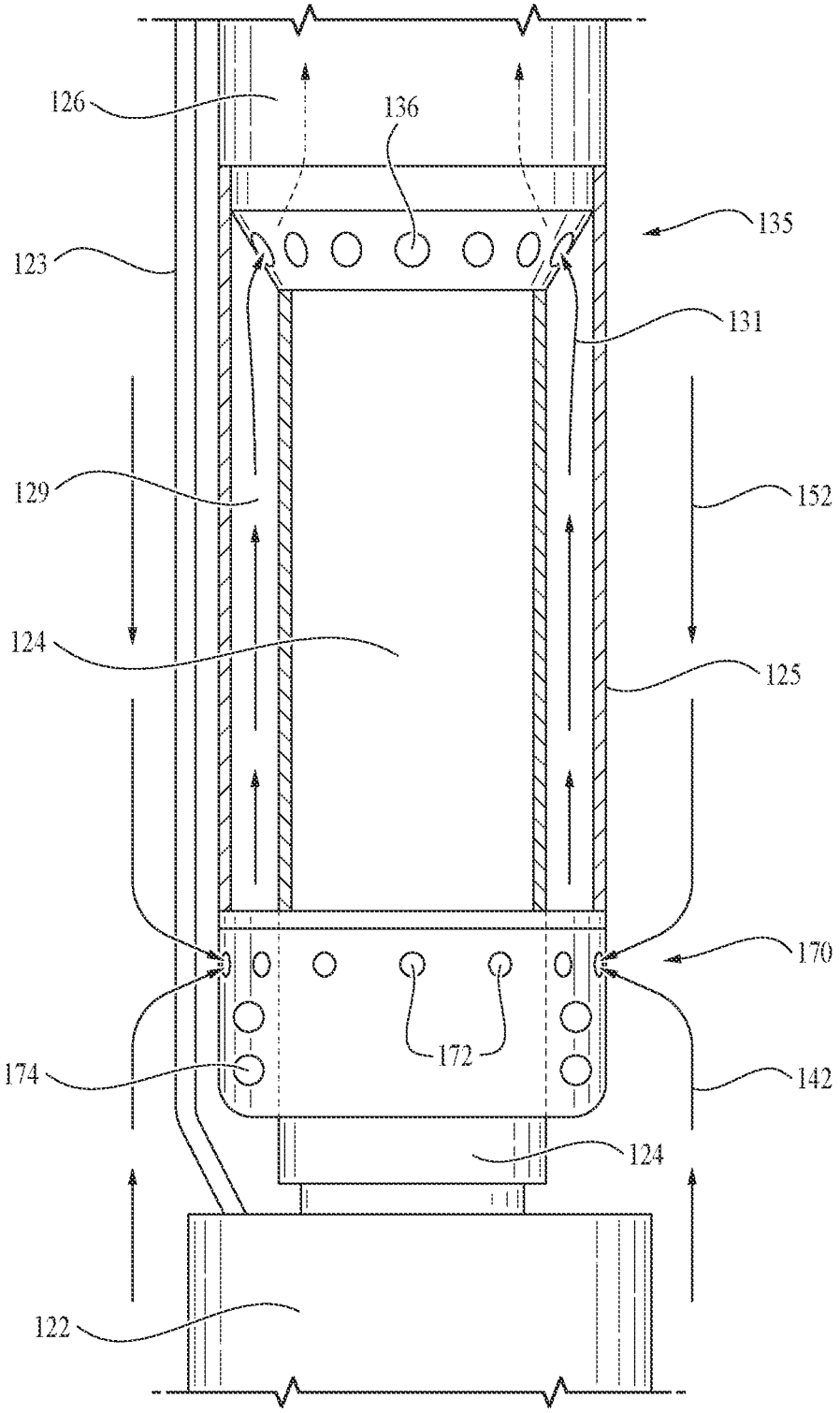
FIG. 3 is an illustration of a portion of an ESP assembly according to an embodiment of the disclosure.

Turning now to FIG. 3, an inlet clamp 170 is described. In an embodiment, the intake extension tubular 125 is coupled to an outside of the seal section 124 at a downhole end of the seal section 124 by an inlet clamp 170. In an embodiment, the inlet clamp 170 may be coupled to an outside of the electric motor 122. The inlet clamp 170 may be provided in two halves, one half having bolt holes 174 and the other half having threaded holes aligned with bolt holes 174. Bolts (not shown) can be passed through the bolt holes 174 to thread into the aligned threaded holes to secure the two halves of the inlet clamp 170 together and to couple to the outside of the seal section 124. The uphole end of the inlet clamp 170 couples to a downhole end of the intake extension tubular. The inlet clamp 170 defines a plurality of inlet ports 172 that allow the reservoir fluid 142 and the second fluid portion 152 to enter the flow path 129 inside the intake extension tubular 125. In an embodiment, the inlet ports 172 of the inlet clamp 170 may receive and secure the downhole open ends of the plurality of intake extension tubulars 137 described above with reference to FIG. 2B, thereby securing the downhole ends of the plurality of intake extension tubulars 137 and preventing them from hanging on the wellbore 102 or casing 104 during run-in of the ESP assembly 132.

Figure 4:
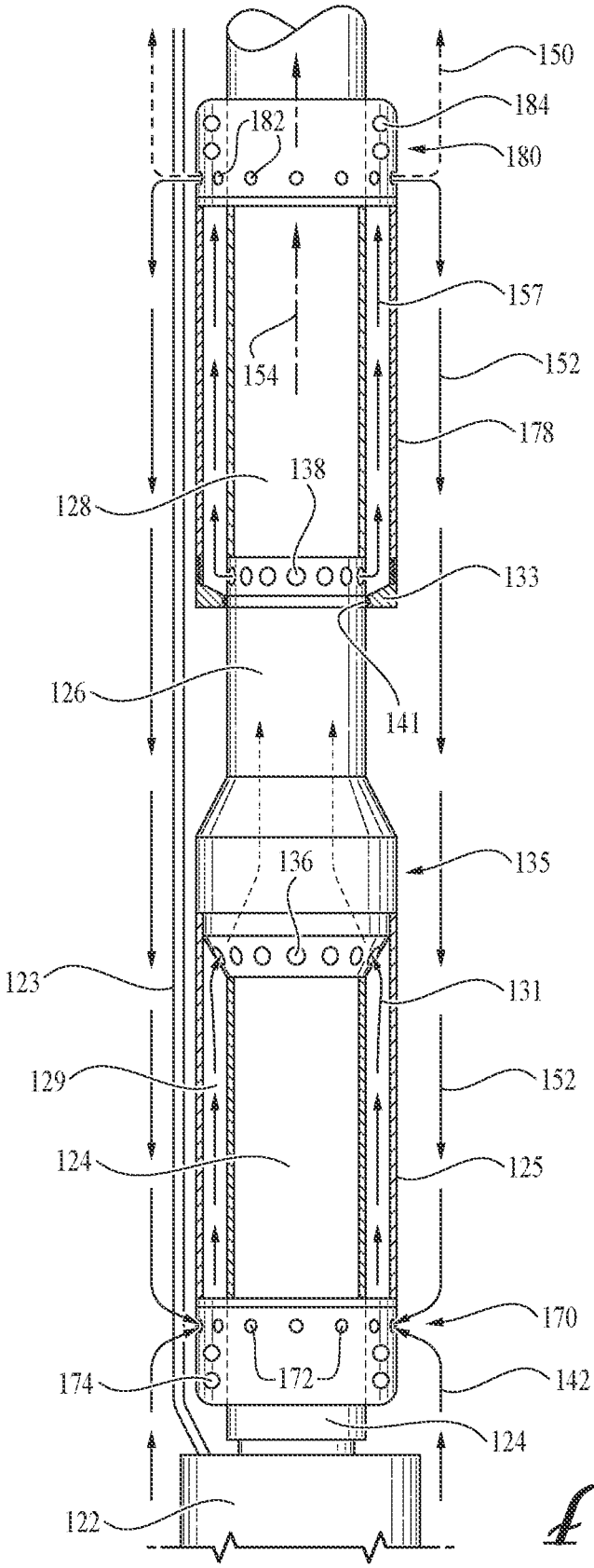
FIG. 4 is an illustration of a portion of an ESP assembly according to an embodiment of the disclosure.

Turning now to FIG. 4, the ESP assembly 132 with the intake extension tubular 125 is illustrated in an embodiment comprising an inverted shroud 178. In an embodiment, the inverted shroud 178 is coupled at a downhole end to an outside of the gas separator assembly 126 below gas phase discharge ports 138, extending uphole over the centrifugal pump assembly 128 and coupling at an uphole end via an outlet clamp 180 to the outside of the centrifugal pump 128. In an embodiment, the outlet clamp 180 may be formed from two separate sections that mate to secure an uphole end of the inverted shroud 178 and to attach to the outside of the centrifugal pump assembly 128. The outlet clamp 180 defines outlet ports 182 and bolt holes 184. The bolt holes 184 align with threaded bolt holes on an opposite section of the outlet clamp 180. Bolts may be inserted through the bolt holes 184 and threaded into the threaded bolt holes on the opposite section of the outlet clamp 180.

In the embodiment of FIG. 4, a fluid 157 exits the gas phase discharge ports 138 of the gas separator 126 not into the annulus between the wellbore 102 and the outside of the ESP assembly 132, as in FIG. 2A, but rather into an annulus formed between an inside of the inverted shroud 178 and an outside of the centrifugal pump assembly 128. The fluid 157 may be considered to be a gas rich fluid mixture (e.g., a fluid mixture that has a higher gas-to-liquid ratio than the fluid 131 prior to separating gas rich fluid from liquid rich fluid in the separation chamber of the gas separator assembly 126). The fluid 157 flows uphole in the annulus inside the inverted shroud 178 to the outlet clamp 180 and exhausts through the outlet ports 182 into the annulus between the wellbore 102 and the outside of the ESP assembly 132. Once outside the outlet ports 182, the fluid 157 may separate into the gas phase fluid 150 that flows uphole in the wellbore 102 and the liquid phase fluid 152 that flows downhole in the wellbore 102, as described above with reference to FIG. 2A. As mentioned above, the combination of the inverted shroud 178 with the intake extension tubular 125 can increase the distance of the flow path fluid leaving the gas phase discharge ports 138 would have to travel to recirculate into the intake extension tubular 125 and into the gas separator assembly 126, which provides the benefit of both allowing more gas to bubble from the fluid exhausted out the gas phase discharge ports 138 as well as providing a higher volume of fluid reservoir to help maintain operations during a transient gas slug.

When an inverted shroud 178 is combined with the intake extension tubular 125, the outside diameter of the intake extension tubular 125 and the outside diameter of the inverted shroud 178 may be about the same. For example, in an embodiment, the outside diameter of the intake extension tubular 125 may be equal to the outside diameter of the inverted shroud 178 within +/−0.025 inch, within +/−0.05 inch, within +/−0.075 inch, within +/−0.1 inch, within +/−0.15 inch, within +/−0.2 inch, within +/−0.25 inch, within +/−0.3 inch, within +/−0.35 inch, within +/−0.4 inch, within +/−0.45 inch, or within +/−0.5 inch In an embodiment, the outside diameter of the seal section 124, the outside diameter of the gas separator assembly 126, and the outside diameter of the centrifugal pump assembly 128 may be about the same. For example, in an embodiment, the outside diameter the seal section 124 is equal to the outside diameter of the gas separator assembly 126 and to the outside diameter of the centrifugal pump assembly 128 within +/−0.025 inch, within +/−0.05 inch, within +/−0.075 inch, within +/−0.1 inch, within +/−0.15 inch, within +/−0.2 inch, within +/−0.25 inch, within +/−0.3 inch, within +/−0.35 inch, within +/−0.4 inch, within +/−0.45 inch, or within +/−0.5 inch. In an embodiment, the electric cable 123 is coupled to an outside of the inverted shroud 178, coupled to an outside of the intake extension tubular 125, and attaches to the electric motor 122 via a pot head plug (not shown). Because the outside diameters of the intake extension tubular 125 and of the inverted shroud 178 are about the same, the electric cable 123 can be smoothly aligned and remain substantially parallel with a centerline of the ESP assembly 132 without having to make any bends or dips which can help avoid hanging the electric cable 123 on the casing 104 or on other objects when running into the wellbore 102.

The inverted shroud 178 may be made of pipe or other tubular metal. The inverted shroud 178 may be formed by coupling a plurality of sections of pipe of other tubulars together end-to-end, for example by threadingly coupling sections together. The inverted shroud 178 may be between 4 feet and 200 feet in length, between 6 feet and 200 feet in length, between 8 feet and 200 feet in length, between 10 feet and 200 feet in length, between 12 feet and 200 feet in length, between 15 feet and 200 feet in length, between 20 feet and 200 feet in length, between 25 feet and 200 feet in length, between 30 feet and 200 feet in length, between 35 feet and 200 feet in length, between 40 feet and 200 feet in length, between 45 and 200 feet in length, between 50 feet and 200 feet in length, between 70 feet and 200 feet in length, between 100 feet and 200 feet in length. In an embodiment, the inverted shroud 178 may be between 4 feet and 1000 feet in length. In longer inverted shrouds 178, the uphole end of inverted shroud 178 may couple to an outside of the production tubing 134 as illustrated in FIG. 5.

Figure 5:
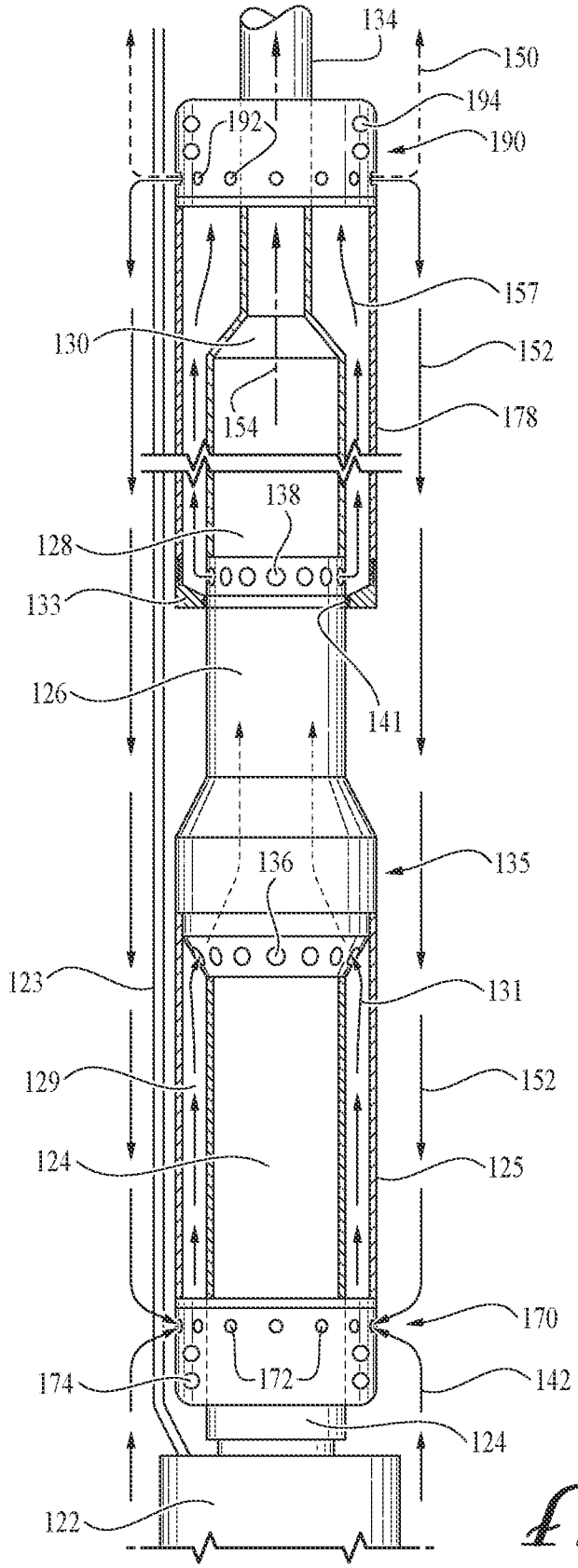
FIG. 5 is an illustration of a portion of an ESP assembly according to an embodiment of the disclosure.

Turning now to FIG. 5, the ESP assembly 132 with the intake extension tubular 125 is illustrated in an embodiment comprising an inverted shroud 178 that couples at an uphole end to the production tubing 134 rather than to the outside of the centrifugal pump assembly as in FIG. 4. It is noted that the inverted shroud 178 of FIG. 5 is substantially similar to the inverted shroud 178 of FIG. 4, with the exception that the outlet clamp 190 differs from the outlet clamp 180 and that the uphole end of the inverted shroud 178 couples to the outside of the production tubing 134. It is also noted that the axial length of the inverted shroud 178 of FIG. 5 is longer than the axial length of the inverted shroud 178 of FIG. 4. The inverted shroud 178 of FIG. 5 may provide the benefit of a longer inverted shroud that extends yet further the distance of the flow path of fluid leaving the gas phase discharge ports 138 recirculating into the intake fluid extension tubular 125. The inverted shroud 178 of FIG. 5 couples at an uphole end via an outlet clamp 190 to the outside of the production tubing. In an embodiment, the outlet clamp 190 may be formed from two separate sections that mate to secure an uphole end of the inverted shroud 178 and to attach to the outside of the production tubing 134. The outlet clamp 190 defines outlet ports 192 and bolt holes 194. The bolt holes 194 align with threaded bolt holes on an opposite section of the outlet clamp 190. Bolts may be inserted through the bolt holes 194 and threaded into the threaded bolt holes on the opposite section of the outlet clamp 190. The inverted shroud 178 may be made of pipe or other tubular metal. The inverted shroud 178 may be formed by coupling a plurality of sections of pipe of other tubulars together end-to-end, for example by threadingly coupling sections together. The inverted shroud 178 may be between 4 feet and 200 feet in length, between 6 feet and 200 feet in length, between 8 feet and 200 feet in length, between 10 feet and 200 feet in length, between 12 feet and 200 feet in length, between 15 feet and 200 feet in length, between 20 feet and 200 feet in length, between 25 feet and 200 feet in length, between 30 feet and 200 feet in length, between 35 feet and 200 feet in length, between 40 feet and 200 feet in length, between 45 and 200 feet in length, between 50 feet and 200 feet in length, between 70 feet and 200 feet in length, between 100 feet and 200 feet in length. In an embodiment, the inverted shroud 178 may be between 4 feet and 1000 feet in length. In longer inverted shrouds 178, the uphole end of inverted shroud 178 may couple to an outside of the production tubing 134 as illustrated in FIG. 5.

Figure 6A:
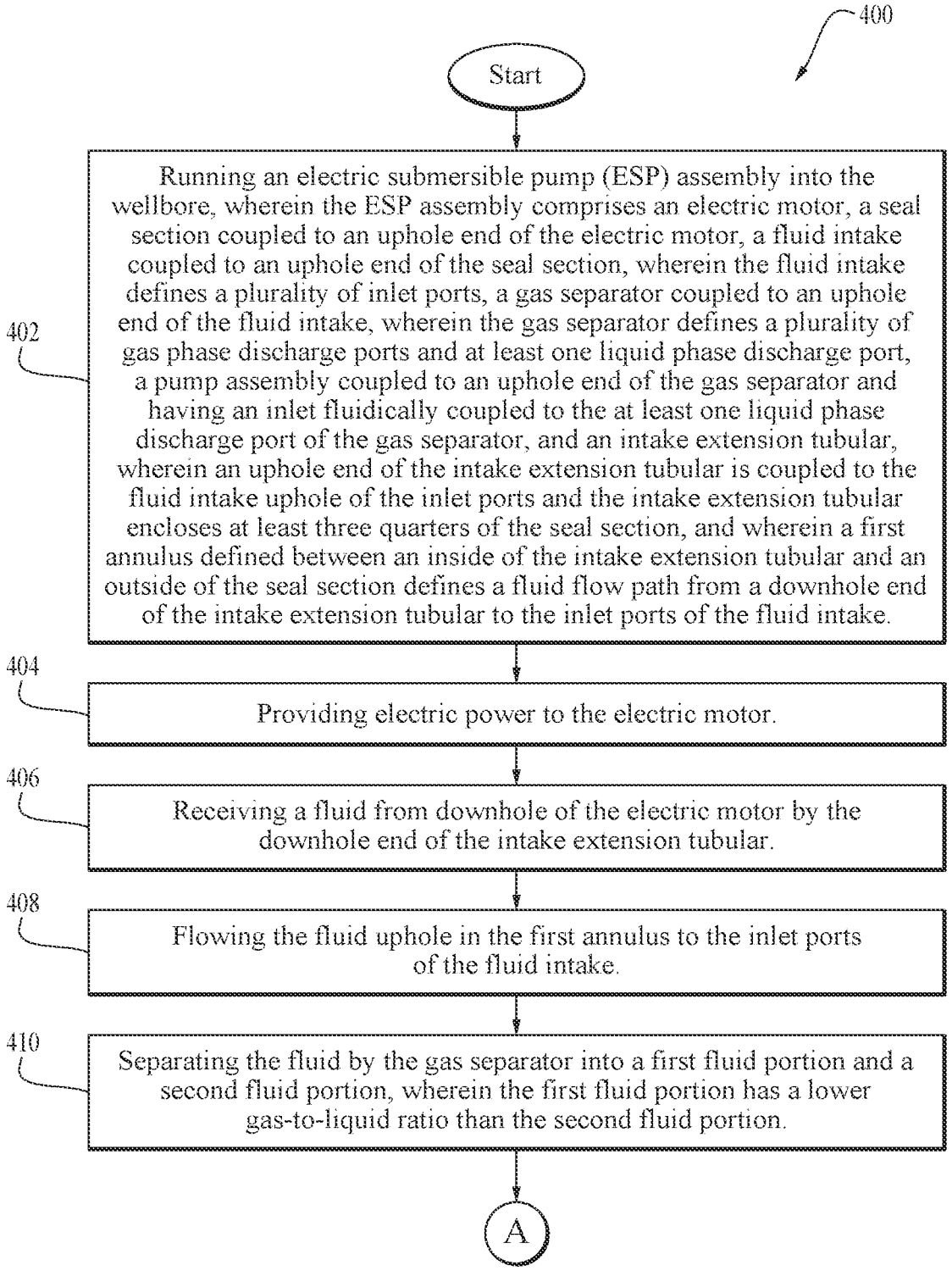
FIG. 6A and FIG. 6B are a flow chart of a method according to an embodiment of the disclosure.
Figure 6B:
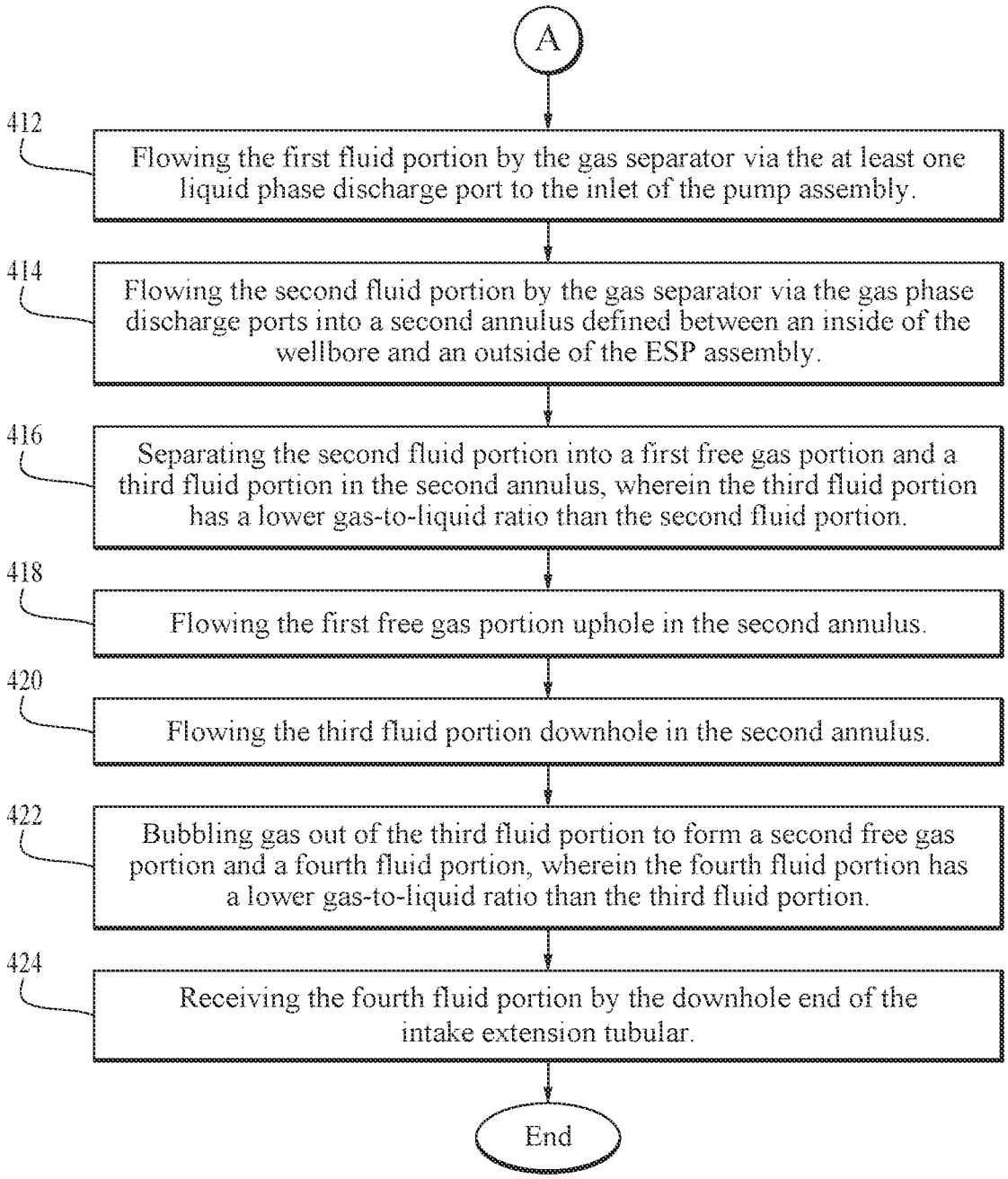

Turning now to FIG. 6A and FIG. 6B, a method 400 is described. In an embodiment, the method 400 is a method of lifting fluid in a wellbore. For example, the method 400 may entail lifting crude oil up the production tubing 134 to the surface 158. The method 400 may entail lifting a mix of crude oil and gas up the production tubing 134 to the surface 158. The method 400 may entail lifting a mix of crude oil and water up the production tubing 134 to the surface 158. The method 400 may entail lifting a mix of crude oil, natural gas, and water up the production tubing 134 to the surface 158. The method 400 may entail lifting hot water up the production tubing 134 to the surface 158, for example in the case of a geothermal well.

At block 402, the method 400 comprises running an electric submersible pump (ESP) assembly into the wellbore 102. In an embodiment, the ESP assembly is substantially the ESP assembly 132 described above with reference to FIG. 1, FIG. 2A or FIG. 2B, and FIG. 3. In an embodiment the ESP assembly comprises an electric motor, a seal section coupled to an uphole end of the electric motor, a fluid intake coupled to an uphole end of the seal section, wherein the fluid intake defines a plurality of inlet ports, a gas separator coupled to an uphole end of the fluid intake, wherein the gas separator defines a plurality of gas phase discharge ports and at least one liquid phase discharge port, a pump assembly coupled to an uphole end of the gas separator and having an inlet fluidically coupled to the at least one liquid phase discharge port of the gas separator, and an intake extension tubular, wherein an uphole end of the intake extension tubular is coupled to the fluid intake uphole of the inlet ports and the intake extension tubular encloses at least three quarters of the seal section, and wherein a first annulus defined between an inside of the intake extension tubular and an outside of the seal section defines a fluid flow path from a downhole end of the intake extension tubular to the inlet ports of the fluid intake. In an embodiment, the intake extension tubular is provided as a plurality of intake extension tubulars 137 as described above with reference to FIG. 2B. In an embodiment, an inlet clamp defining a plurality of inlet ports may be used to secure the bottom of the intake extension tubular to an outside of the seal section. In an embodiment, an outside diameter of the intake extension tubular is about the same as an outside diameter of the gas separator. In an embodiment, the ESP assembly comprises an electric cable that is coupled to an outside of the intake extension tubular and connects to the electric motor.

At block 404, the method 400 comprises providing electric power to the electric motor. For example, electric power is sourced at a surface location proximate the wellbore and distributed down the electric cable 123 to the electric motor 122. At block 406, the method 400 comprises receiving a fluid from downhole of the electric motor by the downhole end of the intake extension tubular. Initially the fluid received may flow from a subterranean formation through perforations in the wellbore 102 and/or in the casing 104. As the ESP assembly continues to operate in the wellbore, at least a portion of the fluid exhausted out the gas phase discharge ports of the gas separator is also received by the downhole end of the intake extension tubular, as for example as described below in block 422 as the fourth fluid portion.

At block 408, the method 400 comprises flowing the fluid uphole in the first annulus to the inlet ports of the fluid intake. In an embodiment, the processing of block 408 comprises flowing the fluid 142 uphole in the fluid flow path 129 to the inlet ports 136 of the fluid intake 135. Alternatively, at block 408, the method 400 comprises flowing the fluid uphole in the plurality of fluid intake tubulars as described with reference to FIG. 2B above.

At block 410, the method 400 comprises separating the fluid by the gas separator into a first fluid portion and a second fluid portion, wherein the first fluid portion has a lower gas-to-liquid ratio than the second fluid portion. In an embodiment, the processing of block 410 comprises a fluid mover in the gas separator causing the fluid to rotate inside the separation chamber of the gas separator to segregate the first fluid portion from the second fluid portion (e.g., the denser first fluid portion congregates towards an outside interior wall of the separation chamber and the less-dense second fluid portion congregates towards a center of the separation chamber, proximate to the outside of the drive shaft of the gas separator).

At block 412, method 400 comprises flowing the first fluid portion by the gas separator via the at least one liquid phase discharge port to the inlet of the pump assembly. At block 414, the method 400 comprises flowing the second fluid portion by the gas separator via the gas phase discharge ports into a second annulus defined between an inside of the wellbore and an outside of the ESP assembly. In an embodiment, the structure of the gas separator that provides the at least one liquid phase discharge port and the gas phase discharge ports may be provided by a cross-over.

At block 416, the method 400 comprises separating the second fluid portion into a first free gas portion and a third fluid portion in the second annulus, wherein the third fluid portion has a lower gas-to-liquid ratio than the second fluid portion. At block 418, the method 400 comprises flowing the first free gas portion uphole in the second annulus.

At block 420, the method 400 comprises flowing the third fluid portion downhole in the second annulus. At block 422, the method 400 comprises bubbling gas out of the third fluid portion to form a second free gas portion and a fourth fluid portion, wherein the fourth fluid portion has a lower gas-to-liquid ratio than the third fluid portion. The processing of block 422 may entail gas that has become emulsified in liquid by the fluid mover in the gas separator to recombine with other gas bubbles. The processing of block 422 may entail gas bubbling free as a result of entering a decreased pressure zone in the wellbore. The processing of block 422 may entail gas bubbling free because the rate of flow of the third fluid portion has decreased sufficiently to allow the gas to move against the direction of flow of the third fluid portion. At block 424, the method 400 comprises receiving the fourth fluid portion by the downhole end of the intake extension tubular. Alternatively, at block 424, the fourth fluid portion is received at the downhole ends of the plurality of intake extension tubulars 137 as described above with reference to FIG. 2B.

In an embodiment, the processing of block 424 comprises mixing the fluid from the subterranean formation (e.g., fluid 142 in FIG. 1) with the fourth fluid portion. In an embodiment, the processing of block 424 comprises further comprising mixing the fluid from downhole of the electric motor with the fourth fluid portion at the downhole end of the intake extension tubular. In an embodiment, the fluid from downhole of the electric motor comprises a transient gas slug and mixing the transient gas slug with the fourth fluid portion at the downhole end of the intake extension tubular provides a liquid fluid portion to the inlet ports of the fluid intake. For example, the ESP may be in a steady-state lifting fluid in the wellbore wherein the fluid received from downhole of the electric motor is wholly liquid phase fluid or mostly liquid phase fluid (e.g., a low gas-to-liquid fluid ratio). Then a gas slug may flow from downhole in the wellbore up to the electric motor and up to the downhole end of the intake extension tubular. This gas slug may persist at the downhole end of the intake extension tubular for 1 second, for 5 second, for 10 seconds, for 15 seconds, for 20 seconds, for 25 second, for 30 seconds, for 35 seconds, for 40 seconds or longer. While the gas slug persists, the fourth fluid portion may continue to be mixed at the downhole end of the intake extension tubular, thereby providing liquid phase fluid that can lubricate and cool bearings in the gas separator and lubricate and cool bearings in the pump assembly. While the gas slug persists, the fourth fluid portion may continue to be mixed at the downhole end of the intake extension tubular, thereby providing a low gas-to-liquid ratio fluid to the pump assembly to avoid the pump assembly becoming gas locked. After the gas slug passes, the fluid received from downhole of the electric motor may return to being wholly liquid phase fluid or mostly liquid phase fluid.

In an embodiment, a downhole end of the intake extension tubular is coupled to an outside of the seal section by an inlet clamp that defines inlet ports, wherein receiving the fluid from downhole of the electric motor by the downhole end of the intake extension tubular comprises receiving the fluid from downhole of the electric motor by the inlet ports of the inlet clamp, and wherein receiving the fourth fluid portion by the downhole end of the intake extension tubular comprises receiving the fourth fluid portion by the inlet ports of the inlet clamp. In an embodiment, downhole ends of the intake extension tubulars 137 are coupled to an outside of the seal section by an inlet clamp that defines inlet ports, wherein receiving the fluid from downhole of the electric motor by the downhole end of the intake extension tubular comprises receiving the fluid from downhole of the electric motor by the inlet ports of the inlet clamp, and wherein receiving the fourth fluid portion by the downhole ends of the intake extension tubulars 137 comprises receiving the fourth fluid portion by the inlet ports of the inlet clamp.

In an embodiment, the ESP assembly further comprises an inverted shroud that is coupled at a downhole end to an outside of the gas separator below the gas phase discharge ports and is coupled at an uphole end to an outside of the pump assembly or to a production tubing that is coupled to an outlet of the pump assembly, wherein flowing the second fluid portion by the gas separator via the gas phase discharge ports into the second annulus comprises flowing the second fluid uphole within the inverted shroud and flowing into the second annulus by exiting the uphole end of the inverted shroud.

Figure 7:
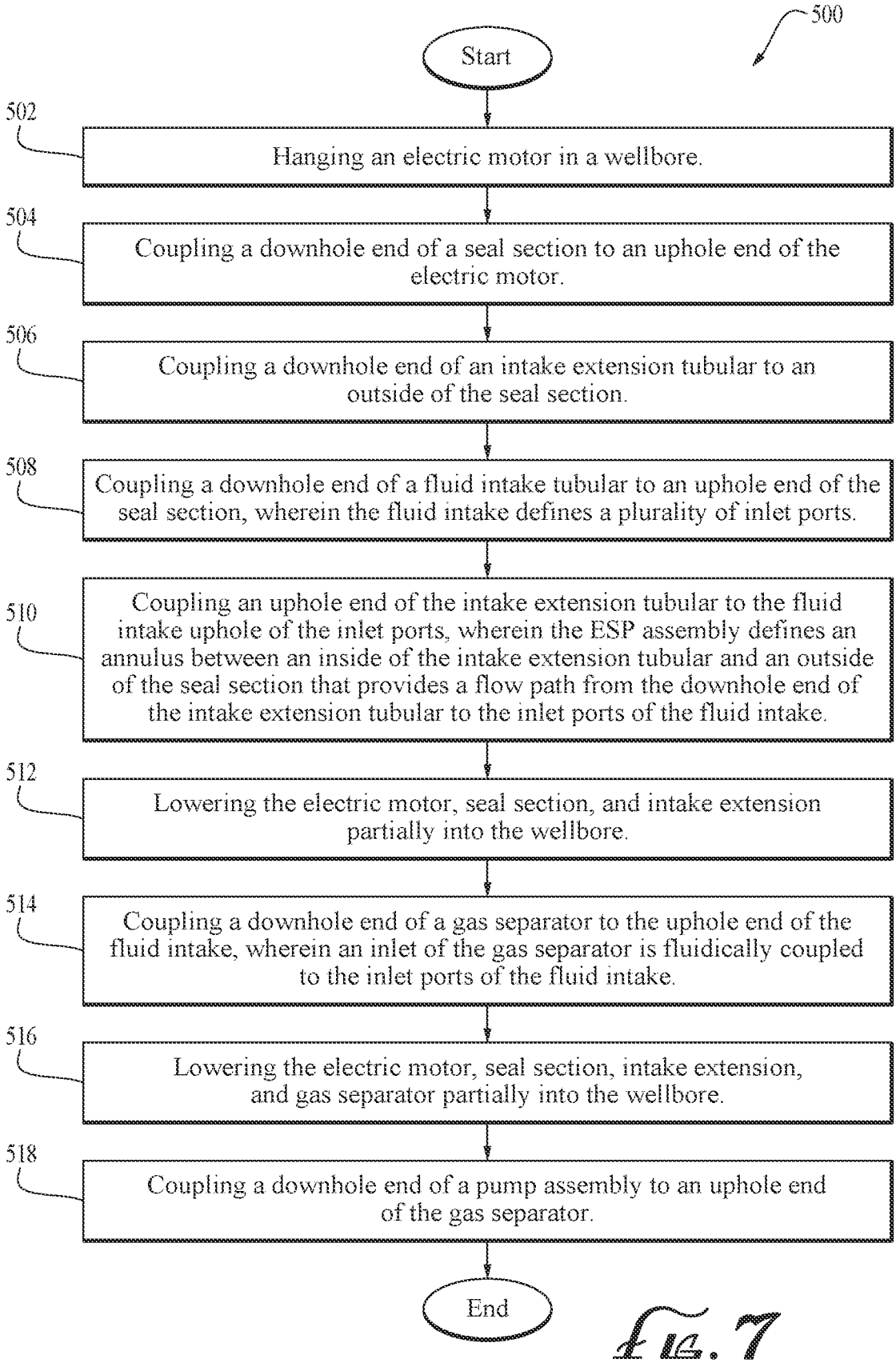
FIG. 7 is a flow chart of a method according to an embodiment of the disclosure.

Turning now to FIG. 7, a method 500 is described. In an embodiment, the method 500 is a method of assembling an electric submersible pump (ESP) assembly. In an embodiment, the method 500 is a method of assembling the ESP assembly 132 described above with reference to FIG. 1, FIG. 2A, FIG. 2B, and FIG. 3. At block 502, the method 500 comprises hanging an electric motor in a wellbore. For example, a mast structure located above the wellbore may support the electric motor from a hoisting mechanism such as a drilling rig and drawworks. Hanging the electric motor in the wellbore may comprise hanging the lower part of the electric motor in the wellbore while retaining the uphole end of the electric motor above a work floor with a retaining tool such as collars or an elevator tool. The processing of block 502 may comprise attaching an electric cable to the electric motor, for example via a pot head connection.

At block 504, the method 500 comprises coupling a downhole end of a seal section to an uphole end of the electric motor. At block 506, the method 500 comprises coupling a downhole end of an intake extension tubular to an outside of the seal section. In an embodiment, the processing of block 506 may comprise coupling the downhole end of the intake extension tubular to the outside of the seal section using an intake clamp such as is described with reference to FIG. 3 above. The processing of block 506 may comprise assembling two halves of an intake clamp to capture a feature at the downhole end of the intake extension tubular by an inside of the intake clamp and to secure the two halves of the intake clamp together with bolts inserted through bolt holes in one of the halves of the intake clamp and threading the bolts into threaded holes located in the other half of the intake clamp. In an embodiment, the processing of block 506 comprises extending a plurality of fluid intake tubulars 137 over the outside of the seal section.

At block 508, the method 500 comprises coupling a downhole end of a fluid intake to an uphole end of the seal section, wherein the fluid intake defines a plurality of inlet ports. At block 510, the method 500 comprises coupling an uphole end of the intake extension tubular to the fluid intake uphole of the inlet ports of the fluid intake, wherein the ESP assembly defines an annulus between an inside of the intake extension tubular and an outside of the seal section that provides a flow path from the downhole end of the intake extension tubular to the inlet ports of the fluid intake. In an embodiment, the method 500 further comprises coupling an electric cable to an outside of the intake extension tubular and connecting a downhole end of the electric cable to the electric motor. In an embodiment, an outside diameter of the intake extension tubular is about the same as an outside diameter of the gas separator. For example, in an embodiment, the outside diameter of the intake extension tubular 125 is equal to the outside diameter of the gas separator assembly 126 within +/−0.025 inch, within +/−0.05 inch, within +/−0.075 inch, within +/−0.1 inch, within +/−0.15 inch, within +/−0.2 inch, within +/−0.25 inch, within +/−0.3 inch, within +/−0.35 inch, within +/−0.4 inch, within +/−0.45 inch, or within +/−0.5 inch.

At block 512, the method 500 comprises lowering the electric motor, seal section, intake extension tubular, and fluid intake partially into the wellbore. In an embodiment, the processing of block 512 may comprise lowering the electric motor, seal section, intake extension tubular, and fluid intake partially into the wellbore by a hoisting mechanism supported by a mast structure and retaining an uphole end of the fluid intake above a work floor with a retaining tool. At block 514, the method 500 comprises coupling a downhole end of a gas separator to the uphole end of the fluid intake, wherein an inlet of the gas separator is fluidically coupled to the inlet ports of the fluid intake.

At block 516, the method 500 comprises lowering the electric motor, seal section, intake extension tubular, fluid intake, and gas separator partially into the wellbore. In an embodiment, the processing of block 516 may comprise lowering the electric motor, seal section, intake extension tubular, fluid intake, and gas separator partially into the wellbore by a hoisting mechanism supported by a mast structure and retaining an uphole end of the gas separator above a work floor with a retaining tool. At block 518, the method 500 comprises coupling a downhole end of a pump assembly to an uphole end of the gas separator. In an embodiment, the pump assembly is a multi-stage centrifugal pump, wherein each stage comprises an impeller coupled to a drive shaft of the pump assembly and a diffuser retained by a housing of the pump assembly. At this point the ESP assembly may be considered completely assembly. On the other hand, other processing steps may also be involved in completing the assembly of the ESP assembly. The method 500 may further comprise securing the electric cable 123 to an outside of the intake extension tubular, to an outside of the gas separator, and/or to an outside of the pump assembly, for example using metal bands. The method 500 may further comprise coupling a fluid outlet to an uphole end of the pump assembly. The method 500 may further comprise coupling an uphole end of the pump assembly and/or an uphole end of the fluid outlet to a production tubing. In an embodiment, the method 500 may further comprise assembling an inverted shroud that couples sealingly to the outside of the gas separator downhole of the gas phase discharge ports of the gas separator and extends upwards over the outside of at least part of the pump assembly and possibly upwards over the outside of at least a lower end of the production tubing.

In an embodiment, the method 500 comprises coupling a downhole end of an inverted shroud to an outside of the gas separator downhole of plurality of gas phase discharge ports of the gas separator and coupling an uphole end of the inverted shroud to an outside of the pump assembly. In another embodiment, the method 500 further comprises coupling a downhole end of an inverted shroud to an outside of the gas separator downhole of plurality of gas phase discharge ports of the gas separator; coupling an uphole end of the pump assembly to a downhole end of a production tubing; and coupling an uphole end of the inverted shroud to an outside of the production tubing.

Additional Disclosure

The following are non-limiting, specific embodiments in accordance with the present disclosure.

A first embodiment, which is an electric submersible pump (ESP) assembly, comprising an electric motor; a seal section coupled to an uphole end of the electric motor; a fluid intake coupled to an uphole end of the seal section, wherein the fluid intake defines a plurality of inlet ports; a gas separator coupled to an uphole end of the fluid intake, wherein the gas separator has a plurality of gas phase discharge ports and at least one liquid phase discharge port; a pump assembly coupled to an uphole end of the gas separator, wherein the pump assembly has a fluid inlet fluidically coupled to the at least one liquid phase discharge port of the gas separator; and an intake extension tubular, wherein an uphole end of the intake extension tubular is coupled to the fluid intake uphole of the inlet ports, wherein the intake extension tubular encloses at least three quarters of the seal section, and wherein an annulus defined between an inside of the intake extension tubular and an outside of the seal section defines a fluid flow path from a downhole end of the intake extension tubular to the inlet ports of the fluid intake.

A second embodiment, which is the ESP assembly of the first embodiment, wherein the gas separator comprises a separation chamber located within the gas separator downhole of the gas phase discharge ports and a fluid mover located downhole of the separation chamber.

A third embodiment, which is the ESP assembly of the first or second embodiment, further comprising an inlet clamp that secures a downhole end of the intake extension tubular to an outside of the seal section wherein the inlet clamp defines a plurality of inlet ports that are fluidically coupled to the fluid flow path defined by the annulus defined between the inside of the intake extension tubular and an outside of the seal section.

A fourth embodiment, which is the ESP assembly of the third embodiment, wherein the inlet clamp comprises two halves that bolt together.

A fifth embodiment, which is the ESP assembly of any of the first through the fourth embodiment, wherein the pump assembly is a centrifugal pump comprising a plurality of centrifugal pump stages, wherein each centrifugal pump stage comprises an impeller and a diffuser.

A sixth embodiment, which is the ESP assembly of any of the first through the fifth embodiment, further comprising an inverted shroud that is sealingly coupled at a downhole end to an outside of the gas separator at a point on the gas separator downhole of the gas phase discharge ports, wherein the inverted shroud extends up and over the outside of the pump assembly.

A seventh embodiment, which is the ESP assembly of any of the first through the sixth embodiment, wherein an electric power cable is located outside of the intake extension tubular and is coupled to an outside of the intake extension tubular and is connected to the electric motor.

An eighth embodiment, which is a method of lifting fluid in a wellbore, comprising running an electric submersible pump (ESP) assembly into the wellbore, wherein the ESP assembly comprises an electric motor, a seal section coupled to an uphole end of the electric motor, a fluid intake coupled to an uphole end of the seal section, wherein the fluid intake defines a plurality of inlet ports, a gas separator coupled to an uphole end of the fluid intake, wherein the gas separator defines a plurality of gas phase discharge ports and at least one liquid phase discharge port, a pump assembly coupled to an uphole end of the gas separator and having an inlet fluidically coupled to the at least one liquid phase discharge port of the gas separator, and an intake extension tubular, wherein an uphole end of the intake extension tubular is coupled to the fluid intake uphole of the inlet ports and the intake extension tubular encloses at least three quarters of the seal section, and wherein a first annulus defined between an inside of the intake extension tubular and an outside of the seal section defines a fluid flow path from a downhole end of the intake extension tubular to the inlet ports of the fluid intake; providing electric power to the electric motor; receiving a fluid from downhole of the electric motor by the downhole end of the intake extension tubular; flowing the fluid uphole in the first annulus to the inlet ports of the fluid intake; separating the fluid by the gas separator into a first fluid portion and a second fluid portion, wherein the first fluid portion has a lower gas-to-liquid ratio than the second fluid portion; flowing the first fluid portion by the gas separator via the at least one liquid phase discharge port to the inlet of the pump assembly; flowing the second fluid portion by the gas separator via the gas phase discharge ports into a second annulus defined between an inside of the wellbore and an outside of the ESP assembly; separating the second fluid portion into a first free gas portion and a third fluid portion in the second annulus, wherein the third fluid portion has a lower gas-to-liquid ratio than the second fluid portion; flowing the first free gas portion uphole in the second annulus; flowing the third fluid portion downhole in the second annulus; bubbling gas out of the third fluid portion to form a second free gas portion and a fourth fluid portion, wherein the fourth fluid portion has a lower gas-to-liquid ratio than the third fluid portion; and receiving the fourth fluid portion by the downhole end of the intake extension tubular.

A ninth embodiment, which is the method of the eighth embodiment, further comprising mixing the fluid from downhole of the electric motor with the fourth fluid portion at the downhole end of the intake extension tubular.

A tenth embodiment, which is the method of the ninth embodiment, wherein the fluid from downhole of the electric motor comprises a transient gas slug and mixing the transient gas slug with the fourth fluid portion at the downhole end of the intake extension tubular provides a liquid fluid portion to the inlet ports of the fluid intake.

An eleventh embodiment, which is the method of any of the eighth through the tenth embodiment, wherein the a downhole end of the intake extension tubular is coupled to an outside of the seal section by an inlet clamp that defines inlet ports, wherein receiving the fluid from downhole of the electric motor by the downhole end of the intake extension tubular comprises receiving the fluid from downhole of the electric motor by the inlet ports of the inlet clamp, and wherein receiving the fourth fluid portion by the downhole end of the intake extension tubular comprises receiving the fourth fluid portion by the inlet ports of the inlet clamp.

A twelfth embodiment, which is the method of any of the eighth through the eleventh embodiment, wherein the ESP assembly further comprises an inverted shroud that is coupled at a downhole end to an outside of the gas separator below the gas phase discharge ports and is coupled at an uphole end to an outside of the pump assembly or to a production tubing that is coupled to an outlet of the pump assembly, wherein flowing the second fluid portion by the gas separator via the gas phase discharge ports into the second annulus comprises flowing the second fluid uphole within the inverted shroud and flowing into the second annulus by exiting the uphole end of the inverted shroud.

A thirteenth embodiment, which is the method of any of the eighth through the twelfth embodiment, wherein an outside diameter of the intake extension tubular is about the same as an outside diameter of the gas separator.

A fourteenth embodiment, which is the method of the thirteenth embodiment, wherein the ESP assembly comprises an electric cable that is coupled to an outside of the intake extension tubular and connects to the electric motor.

A fifteenth embodiment, which is a method of assembling an electric submersible pump (ESP) assembly, comprising hanging an electric motor in a wellbore; coupling a downhole end of a seal section to an uphole end of the electric motor; coupling a downhole end of an intake extension tubular to an outside of the seal section; coupling a downhole end of a fluid intake to an uphole end of the seal section, wherein the fluid intake defines a plurality of inlet ports; coupling an uphole end of the intake extension tubular to the fluid intake uphole of the inlet ports of the fluid intake, wherein the ESP assembly defines an annulus between an inside of the intake extension tubular and an outside of the seal section that provides a flow path from the downhole end of the intake extension tubular to the inlet ports of the fluid intake; lowering the electric motor, seal section, intake extension tubular, and fluid intake partially into the wellbore; coupling a downhole end of a gas separator to the uphole end of the fluid intake, wherein an inlet of the gas separator is fluidically coupled to the inlet ports of the fluid intake; lowering the electric motor, seal section, intake extension tubular, fluid intake, and gas separator partially into the wellbore; and coupling a downhole end of a pump assembly to an uphole end of the gas separator.

A sixteenth embodiment, which is the method of the fifteenth embodiment, further comprising coupling an electric cable to an outside of the intake extension tubular; and connecting a downhole end of the electric cable to the electric motor.

A seventeenth embodiment, which is the method of the fifteenth or sixteenth embodiment, wherein an outside diameter of the intake extension tubular is about the same as an outside diameter of the gas separator.

An eighteenth embodiment, which is the method of any of the fifteenth through the seventeenth embodiment, further comprising coupling a downhole end of an inverted shroud to an outside of the gas separator downhole of plurality of gas phase discharge ports of the gas separator; and coupling an uphole end of the inverted shroud to an outside of the pump assembly.

A nineteenth embodiment, which is the method of any of the fifteenth through the eighteenth embodiment, further comprising coupling a downhole end of an inverted shroud to an outside of the gas separator downhole of plurality of gas phase discharge ports of the gas separator; coupling an uphole end of the pump assembly to an downhole end of a production tubing; and coupling an uphole end of the inverted shroud to an outside of the production tubing.

A twentieth embodiment, which is the method of any of the fifteenth through the nineteenth embodiment, wherein the pump assembly is a multi-stage centrifugal pump.

A twenty-first embodiment, which is an electric submersible pump (ESP) assembly comprising: an electric motor; a seal section coupled to an uphole end of the electric motor, a fluid intake coupled to an uphole end of the seal section, wherein the fluid intake defines a plurality of inlet ports; a gas separator coupled to an uphole end of the fluid intake, wherein the gas separator has a plurality of gas phase discharge ports and at least one liquid phase discharge port; a pump assembly coupled to an uphole end of the gas separator, wherein the pump assembly has a fluid inlet fluidically coupled to the at least one liquid phase discharge port of the gas separator; and at least one intake extension tubular.

A twenty-second embodiment, which is the ESP assembly of the twenty-first embodiment, wherein the at least one intake extension tubular is a single intake extension tubular, wherein an uphole end of the intake extension tubular is coupled to the fluid intake uphole of the inlet ports, wherein the intake extension tubular encloses at least three quarters of the seal section, and wherein an annulus defined between an inside of the intake extension tubular and an outside of the seal section defines a fluid flow path from a downhole end of the intake extension tubular to the inlet ports of the fluid intake.

A twenty-third embodiment, which is the ESP assembly of the twenty-first embodiment, wherein the at least one intake extension tubular comprises a plurality of intake extension tubulars, and wherein each different intake extension tubular is coupled to a different one of the inlet ports.

A twenty-fourth embodiment, which is the ESP assembly of the twenty-third embodiment, wherein each of the plurality of intake extension tubulars extend downhole from the inlet port to which it is coupled over an outside of the seal section.

A twenty-fifth embodiment, which is the ESP assembly of the twenty-fourth embodiment, wherein each of the plurality of intake extension tubulars extends downhole from the inlet port at least two thirds of the length of the seal section.

A twenty-sixth embodiment, which is the ESP assembly of any of the twenty-third through the twenty-fifth embodiment, wherein each intake extension tubular is coupled to its associated inlet port by a weld.

A twenty-seventh embodiment, which is the ESP assembly of any of the twenty-third through the twenty-fifth embodiment, wherein each intake extension tubular is coupled to its associated inlet port by at least one bolt.

A twenty-eighth embodiment, which is the ESP assembly of any of the twenty-third through the twenty-seventh embodiment, wherein the intake extension tubulars are secured to an outside of the seal section by a retaining band.

A twenty-ninth embodiment, which is the ESP assembly of any of the twenty-third through the twenty-seventh embodiment, wherein the intake extension tubulars are secured to an outside of the electric motor by a retaining band.

A thirtieth embodiment, which is the ESP assembly of any of the twenty-third through the twenty-ninth embodiment, further comprising an inlet clamp that defines a plurality of inlet ports, wherein each of the intake extension tubulars is retained at a downhole end by one of the inlet ports of the inlet clamp, and wherein the inlet clamp secures the intake extension tubulars to an outside of the seal section or to an outside of the electric motor.

A thirty-first embodiment, which is a method of lifting fluid in a wellbore, comprising running an electric submersible pump (ESP) assembly into the wellbore, wherein the ESP assembly comprises an electric motor, a seal section coupled to an uphole end of the electric motor, a fluid intake coupled to an uphole end of the seal section, wherein the fluid intake defines a plurality of inlet ports, a gas separator coupled to an uphole end of the fluid intake, wherein the gas separator defines a plurality of gas phase discharge ports and at least one liquid phase discharge port, a pump assembly coupled to an uphole end of the gas separator and having an inlet fluidically coupled to the at least one liquid phase discharge port of the gas separator, and at least one intake extension tubular; providing electric power to the electric motor; receiving a fluid from downhole of the electric motor by a downhole end of the intake extension tubular; flowing the fluid uphole in the at least one intake extension tubular to the inlet ports of the fluid intake; separating the fluid by the gas separator into a first fluid portion and a second fluid portion, wherein the first fluid portion has a lower gas-to-liquid ratio than the second fluid portion; flowing the first fluid portion by the gas separator via the at least one liquid phase discharge port to the inlet of the pump assembly; flowing the second fluid portion by the gas separator via the gas phase discharge ports into an annulus defined between an inside of the wellbore and an outside of the ESP assembly; separating the second fluid portion into a first free gas portion and a third fluid portion in the annulus, wherein the third fluid portion has a lower gas-to-liquid ratio than the second fluid portion; flowing the first free gas portion uphole in the annulus; flowing the third fluid portion downhole in the annulus; bubbling gas out of the third fluid portion to form a second free gas portion and a fourth fluid portion, wherein the fourth fluid portion has a lower gas-to-liquid ratio than the third fluid portion; and receiving the fourth fluid portion by the downhole end of the at least one intake extension tubular.

A thirty-second embodiment, which is the method of the thirty-first embodiment, wherein the at least one intake extension tubular is a single intake extension tubular, wherein an uphole end of the intake extension tubular is coupled to the fluid intake uphole of the inlet ports, wherein the intake extension tubular encloses at least three quarters of the seal section, and wherein an annulus defined between an inside of the intake extension tubular and an outside of the seal section defines a fluid flow path from a downhole end of the intake extension tubular to the inlet ports of the fluid intake.

A thirty-third embodiment, which is the method of the thirty-first embodiment, wherein the at least one intake extension tubular comprises a plurality of intake extension tubulars, and wherein each different intake extension tubular is coupled to a different one of the inlet ports.

A thirty-fourth embodiment, which is a method of lifting fluid in a wellbore, comprising running an electric submersible pump (ESP) assembly into the wellbore, wherein the ESP assembly comprises the ESP assembly according to any of the twenty-third through the thirtieth embodiment described above; providing electric power to the electric motor; receiving a fluid from downhole of the electric motor by a downhole end of the intake extension tubular; flowing the fluid uphole in the at least one intake extension tubular to the inlet ports of the fluid intake; separating the fluid by the gas separator into a first fluid portion and a second fluid portion, wherein the first fluid portion has a lower gas-to-liquid ratio than the second fluid portion; flowing the first fluid portion by the gas separator via the at least one liquid phase discharge port to the inlet of the pump assembly; flowing the second fluid portion by the gas separator via the gas phase discharge ports into an annulus defined between an inside of the wellbore and an outside of the ESP assembly; separating the second fluid portion into a first free gas portion and a third fluid portion in the annulus, wherein the third fluid portion has a lower gas-to-liquid ratio than the second fluid portion; flowing the first free gas portion uphole in the annulus; flowing the third fluid portion downhole in the annulus; bubbling gas out of the third fluid portion to form a second free gas portion and a fourth fluid portion, wherein the fourth fluid portion has a lower gas-to-liquid ratio than the third fluid portion; and receiving the fourth fluid portion by the downhole end of the at least one intake extension tubular.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. An electric submersible pump (ESP) assembly, comprising:

an electric motor;

a seal section coupled to an uphole end of the electric motor;

a fluid intake coupled to an uphole end of the seal section, wherein the fluid intake defines a plurality of inlet ports;

a gas separator coupled to an uphole end of the fluid intake, wherein the gas separator has a plurality of gas phase discharge ports and at least one liquid phase discharge port;

a pump assembly coupled to an uphole end of the gas separator, wherein the pump assembly has a fluid inlet fluidically coupled to the at least one liquid phase discharge port of the gas separator; and an intake extension tubular, wherein an uphole end of the intake extension tubular is coupled to the fluid intake uphole of the inlet ports, wherein the intake extension tubular encloses at least three quarters of the seal section, and wherein an annulus defined between an inside of the intake extension tubular and an outside of the seal section defines a fluid flow path from a downhole end of the intake extension tubular to the inlet ports of the fluid intake, wherein an inner diameter of the intake extension tubular is less than an outer diameter of the gas separator.

2. The ESP assembly of claim 1, wherein the gas separator comprises a separation chamber located within the gas separator downhole of the gas phase discharge ports and a fluid mover located downhole of the separation chamber.

3. The ESP assembly of claim 1, further comprising an inlet clamp that secures a downhole end of the intake extension tubular to an outside of the seal section wherein the inlet clamp defines a plurality of inlet ports that are fluidically coupled to the fluid flow path defined by the annulus defined between the inside of the intake extension tubular and an outside of the seal section.

4. The ESP assembly of claim 3, wherein the inlet clamp comprises two halves that bolt together.

5. The ESP assembly of claim 1, wherein the pump assembly is a centrifugal pump comprising a plurality of centrifugal pump stages, wherein each centrifugal pump stage comprises an impeller and a diffuser.

6. The ESP assembly of claim 1, further comprising an inverted shroud that is sealingly coupled at a downhole end to an outside of the gas separator at a point on the gas separator downhole of the gas phase discharge ports, wherein the inverted shroud extends up and over the outside of the pump assembly.

7. The ESP assembly of claim 1, wherein an electric power cable is located outside of the intake extension tubular and is coupled to an outside of the intake extension tubular and is connected to the electric motor.

8. A method of lifting fluid in a wellbore, comprising:

running an electric submersible pump (ESP) assembly into the wellbore, wherein the ESP assembly comprises an electric motor, a seal section coupled to an uphole end of the electric motor, a fluid intake coupled to an uphole end of the seal section, wherein the fluid intake defines a plurality of inlet ports, a gas separator coupled to an uphole end of the fluid intake, wherein the gas separator defines a plurality of gas phase discharge ports and at least one liquid phase discharge port, a pump assembly coupled to an uphole end of the gas separator and having an inlet fluidically coupled to the at least one liquid phase discharge port of the gas separator, and an intake extension tubular, wherein an uphole end of the intake extension tubular is coupled to the fluid intake uphole of the inlet ports and the intake extension tubular encloses at least three quarters of the seal section, and wherein a first annulus defined between an inside of the intake extension tubular and an outside of the seal section defines a fluid flow path from a downhole end of the intake extension tubular to the inlet ports of the fluid intake, wherein an inner diameter of the intake extension tubular is less than an outer diameter of the gas separator;

providing electric power to the electric motor;

receiving a fluid from downhole of the electric motor by the downhole end of the intake extension tubular;

flowing the fluid uphole in the first annulus to the inlet ports of the fluid intake;

separating the fluid by the gas separator into a first fluid portion and a second fluid portion, wherein the first fluid portion has a lower gas-to-liquid ratio than the second fluid portion;

flowing the first fluid portion by the gas separator via the at least one liquid phase discharge port to the inlet of the pump assembly;

flowing the second fluid portion by the gas separator via the gas phase discharge ports into a second annulus defined between an inside of the wellbore and an outside of the ESP assembly;

separating the second fluid portion into a first free gas portion and a third fluid portion in the second annulus, wherein the third fluid portion has a lower gas-to-liquid ratio than the second fluid portion;

flowing the first free gas portion uphole in the second annulus;

flowing the third fluid portion downhole in the second annulus;

bubbling gas out of the third fluid portion to form a second free gas portion and a fourth fluid portion, wherein the fourth fluid portion has a lower gas-to-liquid ratio than the third fluid portion; and receiving the fourth fluid portion by the downhole end of the intake extension tubular.

9. The method of claim 8, further comprising mixing the fluid from downhole of the electric motor with the fourth fluid portion at the downhole end of the intake extension tubular.

10. The method of claim 9, wherein the fluid from downhole of the electric motor comprises a transient gas slug and mixing the transient gas slug with the fourth fluid portion at the downhole end of the intake extension tubular provides a liquid fluid portion to the inlet ports of the fluid intake.

11. The method of claim 8, wherein the downhole end of the intake extension tubular is coupled to an outside of the seal section by an inlet clamp that defines inlet ports, wherein receiving the fluid from downhole of the electric motor by the downhole end of the intake extension tubular comprises receiving the fluid from downhole of the electric motor by the inlet ports of the inlet clamp, and wherein receiving the fourth fluid portion by the downhole end of the intake extension tubular comprises receiving the fourth fluid portion by the inlet ports of the inlet clamp.

12. The method of claim 8, wherein the ESP assembly further comprises an inverted shroud that is coupled at a downhole end to an outside of the gas separator below the gas phase discharge ports and is coupled at an uphole end to an outside of the pump assembly or to a production tubing that is coupled to an outlet of the pump assembly, wherein flowing the second fluid portion by the gas separator via the gas phase discharge ports into the second annulus comprises flowing the second fluid uphole within the inverted shroud and flowing into the second annulus by exiting the uphole end of the inverted shroud.

13. The method of claim 8, wherein an outer diameter of the intake extension tubular is within +/−0.5 inches of the outer diameter of the gas separator.

14. The method of claim 13, wherein the ESP assembly comprises an electric cable that is coupled to an outside of the intake extension tubular and connects to the electric motor.

15. A method of assembling an electric submersible pump (ESP) assembly, comprising:

hanging an electric motor in a wellbore;

coupling a downhole end of a seal section to an uphole end of the electric motor;

coupling a downhole end of an intake extension tubular to an outside of the seal section;

coupling a downhole end of a fluid intake to an uphole end of the seal section, wherein the fluid intake defines a plurality of inlet ports;

coupling an uphole end of the intake extension tubular to the fluid intake uphole of the inlet ports of the fluid intake, wherein the ESP assembly defines an annulus between an inside of the intake extension tubular and an outside of the seal section that provides a flow path from the downhole end of the intake extension tubular to the inlet ports of the fluid intake, and wherein an inner diameter of the intake extension tubular is less than an outer diameter of the gas separator;

lowering the electric motor, seal section, intake extension tubular, and fluid intake partially into the wellbore;

coupling a downhole end of a gas separator to the uphole end of the fluid intake, wherein an inlet of the gas separator is fluidically coupled to the inlet ports of the fluid intake;

lowering the electric motor, seal section, intake extension tubular, fluid intake, and gas separator partially into the wellbore; and coupling a downhole end of a pump assembly to an uphole end of the gas separator.

16. The method of claim 15, further comprising:

coupling an electric cable to an outside of the intake extension tubular; and connecting a downhole end of the electric cable to the electric motor.

17. The method of claim 15, wherein an outer diameter of the intake extension tubular is within +/−0.5 inches of the outer diameter of the gas separator.

18. The method of claim 15, further comprising:

coupling a downhole end of an inverted shroud to an outside of the gas separator downhole of plurality of gas phase discharge ports of the gas separator; and coupling an uphole end of the inverted shroud to an outside of the pump assembly.

19. The method of claim 15, further comprising:

coupling a downhole end of an inverted shroud to an outside of the gas separator downhole of plurality of gas phase discharge ports of the gas separator;

coupling an uphole end of the pump assembly to an downhole end of a production tubing; and coupling an uphole end of the inverted shroud to an outside of the production tubing.

20. The method of claim 15, wherein the pump assembly is a multi-stage centrifugal pump.

* * * * *